US010636558B2

(12) United States Patent
Uchida et al.

(10) Patent No.: US 10,636,558 B2
(45) Date of Patent: Apr. 28, 2020

(54) CERAMIC CORE, WIRE-WOUND ELECTRONIC COMPONENT, AND MANUFACTURING METHOD FOR CERAMIC CORE

(71) Applicant: MURATA MANUFACTURING CO., LTD., Kyoto-fu (JP)

(72) Inventors: Takeshi Uchida, Nagaokakyo (JP); Akira Kurakake, Nagaokakyo (JP); Kazuyoshi Ishizuka, Nagaokakyo (JP); Kazuhiro Yoshii, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/583,589

(22) Filed: May 1, 2017

(65) Prior Publication Data

US 2017/0330676 A1 Nov. 16, 2017

(30) Foreign Application Priority Data

May 13, 2016 (JP) ..... 2016-096759

(51) Int. Cl.
*H01F 27/02* (2006.01)
*H01F 41/00* (2006.01)
(Continued)

(52) U.S. Cl.
CPC ..... *H01F 27/255* (2013.01); *H01F 17/045* (2013.01); *H01F 27/2823* (2013.01); *H01F 27/292* (2013.01); *H01F 41/0246* (2013.01)

(58) Field of Classification Search
CPC .. H01F 17/045; H01F 27/255; H01F 27/2823; H01F 27/292; H01F 41/0246
(Continued)

(56) References Cited

U.S. PATENT DOCUMENTS 5,963,119 A * 10/1999 Takeda ..... H01F 17/0033 336/196
6,157,283 A * 12/2000 Tsunemi ..... H01F 27/292 336/192
(Continued)

FOREIGN PATENT DOCUMENTS

CN 100545961 C 9/2009
JP H1173914 U 12/1989
(Continued)

OTHER PUBLICATIONS

An Office Action mailed by the Chinese Patent Office dated Aug. 1, 2018, which corresponds to Chinese Patent Application No. 201710329226.X and is related to U.S. Appl. No. 15/583,589.
(Continued)

*Primary Examiner* — Mang Tin Bik Lian
(74) *Attorney, Agent, or Firm* — Studebaker & Brackett PC

(57) ABSTRACT

A ceramic core includes an axial core part extended in the longitudinal direction, and a pair of flanges located at both ends in the longitudinal direction of the axial core part and projecting around the periphery of the axial core part in the height and width directions. The ceramic core has a length dimension L in the longitudinal direction of about 0 mm<L≤1.1 mm. A ratio t/T of the thickness dimension t in the height direction of the axial core part to the height dimension T in the height dimension of the flanges, is about 0<t/T≤0.6. A ratio w/W of the width dimension w in the width direction of the axial core part to the width dimension W in the width direction of the flanges, is about 0<w/W≤0.6.

15 Claims, 12 Drawing Sheets

(51) Int. Cl.

| | |
|---|---|
| ***H01F 27/255*** | (2006.01) |
| ***H01F 17/04*** | (2006.01) |
| ***H01F 27/29*** | (2006.01) |
| ***H01F 27/28*** | (2006.01) |
| ***H01F 41/02*** | (2006.01) |

(58) Field of Classification Search
USPC ..... 336/83, 192, 233, 212
See application file for complete search history.

(56) References Cited

U.S. PATENT DOCUMENTS

| | | | | |
|---|---|---|---|---|
| 6,392,523 | B1 * | 5/2002 | Tsunemi | H01F 17/045 336/192 |
| 9,117,580 | B2 * | 8/2015 | Wu | H01F 3/08 |
| 9,208,937 | B2 * | 12/2015 | Wu | H01F 17/045 |
| 9,966,187 | B2 * | 5/2018 | Aoki | H01F 27/292 |
| 2007/0285200 | A1 * | 12/2007 | Hsieh | H01F 27/027 336/83 |
| 2010/0182115 | A1 * | 7/2010 | Huang | H01F 3/10 336/83 |
| 2010/0321144 | A1 * | 12/2010 | Kudo | H01F 17/045 336/192 |
| 2013/0200972 | A1 * | 8/2013 | Wada | H01F 27/02 336/90 |
| 2016/0365191 | A1 * | 12/2016 | Horie | H01F 27/24 |

FOREIGN PATENT DOCUMENTS

| | | | |
|---|---|---|---|
| JP | H2120817 | U | 9/1990 |
| JP | H05-275256 | A | 10/1993 |
| JP | 3016658 | U | 7/1995 |
| JP | H07-183126 | A | 7/1995 |
| JP | 2003257725 | A | 9/2003 |
| JP | 2005-317591 | A | 11/2005 |

OTHER PUBLICATIONS

An Office Action; "Notification of Reasons for Refusal," Mailed by the Japanese Patent Office dated Nov. 6, 2018, which corresponds to Japanese Patent Application No. 2016-096759 and is related to U.S. Appl. No. 15/583,589; with English language translation.

An Office Action mailed by the Chinese Patent Office dated Apr. 19, 2019, which corresponds to Chinese Patent Application No. 201710329228.X and is related to U.S. Appl. No. 15/583,589; with English language translation.

* cited by examiner 80
82
81
90
61
95
62
70
72
71
62C
L1
L2

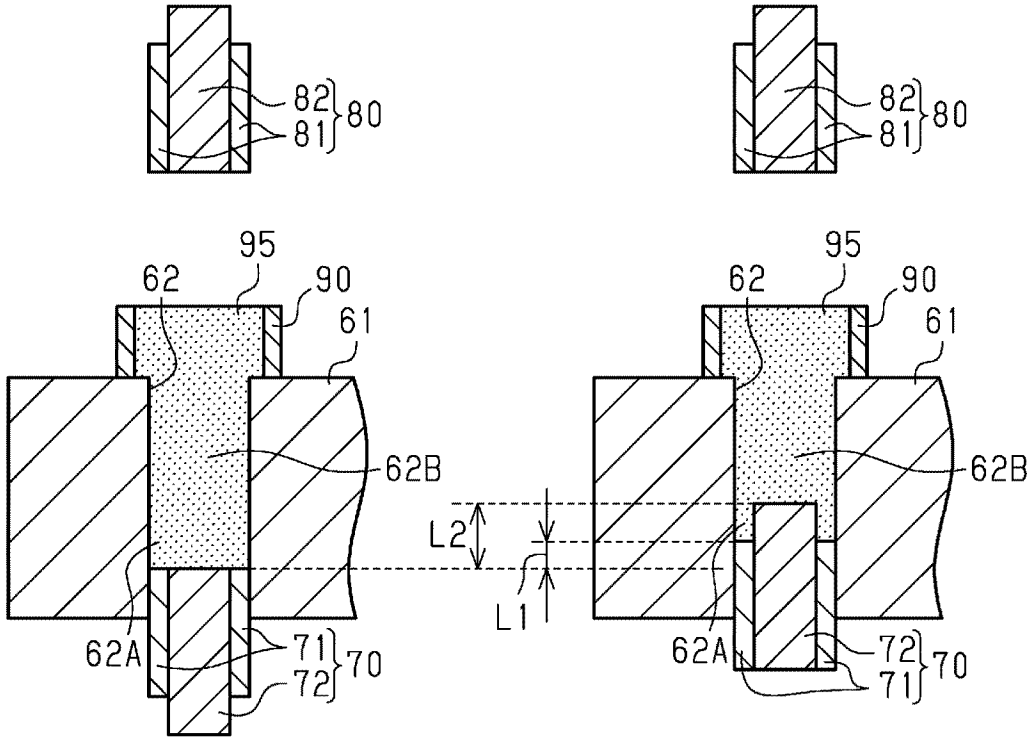
FIG. 11C
FIG. 11B
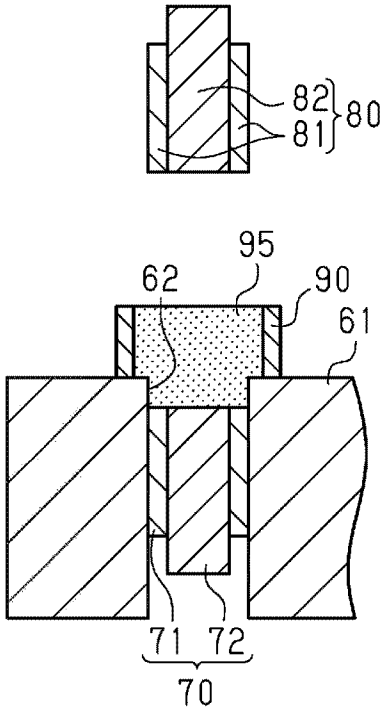
FIG. 11A

CERAMIC CORE, WIRE-WOUND ELECTRONIC COMPONENT, AND MANUFACTURING METHOD FOR CERAMIC CORE

CROSS REFERENCE TO RELATED APPLICATIONS

This application claims benefit of priority to Japanese Patent Application 2016-096759 filed May 13, 2016, the entire content of which is incorporated herein by reference.

TECHNICAL FIELD

The present disclosure relates to a ceramic core, a wire-wound electronic component, and a manufacturing method for a ceramic core.

BACKGROUND

Wire-wound electronic components (for example, coil components) according to related art include a ceramic core and a winding. The ceramic core has an axial core part, and a pair of flanges located at both ends of the axial core part. The winding is wound around the axial core part (see, for example, Japanese Unexamined Patent Application Publication No. 2005-317591). The ceramic core is manufactured as follows. First, as illustrated in FIG. 16A, a lower punch 103 is inserted into a fill cavity 102 in a die 101, and the fill cavity 102 is filled with a charge of ceramic powder 110. Subsequently, an upper punch 105 is advanced into the fill cavity 102 as illustrated in FIG. 16B. Next, as illustrated in FIG. 16C, the ceramic powder 110 filled in the fill cavity 102 is pressed with the lower punch 103 and the upper punch 105 to compact the ceramic powder 110 into a green compact 200. Subsequently, the green compact 200 is ejected from the die 101 as illustrated in FIG. 16D. The green compact 200 is then fired to produce a ceramic core. At this time, each of the lower punch 103 and the upper punch 105 is formed such that its portion corresponding to the axial core part and its portion corresponding to the flange are formed integrally.

Advances in miniaturization and performance of electronic devices such as cellular phones have also led to increasing demand for greater miniaturization and improved characteristics (for example, higher inductances) of wire-wound electronic components incorporated in such electronic devices. To meet such demands, it is becoming increasingly necessary for ceramic cores to provide increased area on which a winding can be wound (that is, increased winding area) while achieving miniaturization. Unfortunately, it has been difficult with the above-mentioned manufacturing method to manufacture a ceramic core that meets the above-mentioned demand.

SUMMARY

The present disclosure has been made to address the above-mentioned problem, and accordingly it is an object of the disclosure to provide a ceramic core, a wire-wound electronic component, and a manufacturing method for a ceramic core that allow for increased winding area while achieving miniaturization.

To address the above-mentioned problem, according to preferred embodiments of the present disclosure, there is provided a ceramic core including an axial core part extended in a longitudinal direction, and a pair of flanges located at both ends in the longitudinal direction of the axial core part, the flanges projecting around the periphery of the axial core part in a height direction and a width direction that are orthogonal to the longitudinal direction, the ceramic core having a dimension L in the longitudinal direction of about 0 mm<L≤1.1 mm. A ratio t/T is about 0<t/T≤0.6, the ratio t/T being the ratio of a dimension t in the height direction of the axial core part to a dimension T in the height direction of each of the flanges. A ratio w/W is about 0<w/W≤0.6, the ratio w/W being the ratio of a dimension w in the width direction of the axial core part to a dimension W in the width direction of each of the flanges.

This configuration ensures, for a small-sized ceramic core with the length dimension L set to about 0 mm<L≤1.1 mm, increased size of the step between the axial core part and the flange in the height direction, as well as increased size of the step between the axial core part and the flange in the width direction. This allows for increased winding area while achieving miniaturization.

In preferred embodiments of the ceramic core, each of the flanges has a dimension D in the longitudinal direction that ranges from about 0.08 mm to 0.15 mm.

In preferred embodiments of the ceramic core, the center of the axial core part in the height direction is displaced relative to the center of each of the flanges in the height direction.

With this configuration, when the ceramic core is employed for a wire-wound electronic component, for example, the clearance between the axial core part and the electrode can be increased by forming the electrode on an end face of the flange located opposite to the direction in which the axial core part is displaced relative to the flange. This ensures increased area for forming the electrode.

In preferred embodiments of the ceramic core, the difference between the proportion of pores present in the axial core part and the proportion of pores present in each of the flanges is equal to or less than about 20%.

This configuration reduces the difference between the compaction density of the axial core part and the compaction density of the flange. That is, the above configuration reduces the difference in compaction density between the axial core part and the flange that differ in thickness. This makes it possible to minimize decreases in the strength of the flange whose compaction density tends to decrease when the manufacturing method according to related art is employed.

In preferred embodiments of the ceramic core, each of the flanges has a principal face connected to the axial core part and facing the other flange, the principal face has a substantially strip-shaped face that connects an end portion in the longitudinal direction of the axial core part with a part of an end portion in the height direction of the principal face, and the substantially strip-shaped face is formed substantially parallel to another portion of the principal face.

With this configuration, the substantially strip-shaped face constituting a part of the principal face of the flange is formed such that the substantially strip-shaped face is flush with other portions of the principal face of the flange and extends substantially parallel to the height direction. That is, the entire principal face of the flange including the substantially strip-shaped face is provided with substantially no inclination. This allows for increased winding area in comparison to when the substantially strip-shaped face is formed as an inclined face.

In preferred embodiments of the ceramic core, when viewed in cross-section taken orthogonal to the longitudinal direction, the axial core part has a body portion having a substantially elliptical or circular shape, and a projection that projects outward from each end portion in the width direction of the body portion.

With this configuration, the cross-section of the axial core part taken orthogonal to the longitudinal direction has a substantially elliptical or circular shape. This allows the winding to be readily wound around the axial core part when the ceramic core is employed for a wire-wound electronic component.

To address the above-mentioned problem, according to preferred embodiments of the present disclosure, there is provided a wire-wound electronic component including the ceramic core mentioned above, an electrode formed on one end face in the height direction of each of the flanges, and a winding wound around the axial core part, the winding being electrically connected at an end portion to the electrode.

This configuration ensures, for a small-sized ceramic core with the length dimension L set to about 0 mm<L≤1.1 mm, increased size of the step between the axial core part and the flange in the height direction, as well as increased size of the step between the axial core part and the flange in the width direction. This allows for increased winding area while achieving miniaturization. Therefore, the number of turns of the winding wound around the axial core part can be increased. As a result, when the wire-wound electronic component is implemented as a coil component, the inductance value of the coil component can be increased.

To address the above-mentioned problem, according to preferred embodiments of the present disclosure, there is provided a manufacturing method for a ceramic core, the ceramic core including an axial core part extended in a longitudinal direction and a pair of flanges located at both ends in the longitudinal direction of the axial core part, the ceramic core having a dimension L in the longitudinal direction of about 0 mm<L≤1.1 mm, the manufacturing method including compacting a ceramic powder filled in a die into a green compact having the axial core part and the flanges by pressing the ceramic powder with a lower punch and an upper punch, the upper punch having a segmented structure including a first upper punch and a second upper punch, the first upper punch corresponding to each of the flanges, the second upper punch corresponding to the axial core part, and firing the green compact. The compacting includes individually controlling the amount of movement of each of the lower punch, the first upper punch, and the second upper punch relative to the die such that a ratio t/T is about 0<t/T≤0.6, the ratio t/T being the ratio of a dimension t in a pressing direction of the axial core part after the firing to a dimension T in the pressing direction of each of the flanges after the firing.

This manufacturing method enables individual control of the amount moved by each of the lower punch, the first upper punch corresponding to the flange, and the second upper punch corresponding to the axial core part. This allows for increased size of the step between the flange and the axial core part in the pressing direction even when the ceramic core being produced has a small size with the length dimension L set equal to or less than about 1.1 mm. This makes it possible to manufacture a ceramic core that allows for increased winding area while being small in size.

In preferred embodiments of the manufacturing method for a ceramic core, the compacting includes individually controlling the amount of movement of each of the lower punch, the first upper punch, and the second upper punch relative to the die such that a ratio R1/R2 is within a range of about 0.9 to 1.1, the ratio R1/R2 being the ratio of the compression ratio R1 of each of the flanges to the compression ratio R2 of the axial core part.

This manufacturing method makes it possible to reduce the difference in compaction density between the flange and the axial core part. This helps to minimize decreases in the strength of the flange whose compaction density tends to decrease.

In preferred embodiments of the manufacturing method for a ceramic core, the compacting includes filling a fill space with the ceramic powder, the fill space being defined by the lower punch and the die, advancing the upper punch into the fill space, pressing the ceramic powder within the fill space by using the upper punch and the lower punch to compact the ceramic powder into the green compact, ejecting the green compact from the die by moving the upper punch and the lower punch upward relative to the die, releasing the green compact by moving the upper punch upward, and separating, after the pressing and before the releasing, the second upper punch from the green compact earlier than the first upper punch.

With this configuration, after the green compact is formed, only the second upper punch of the upper punch is first separated from the green compact. This allows for decreased area of contact between the green compact and the entire upper punch at the time when the remaining first upper punch is separated from the green compact. This helps to reduce the likelihood of the green compact remaining attached to the first upper punch and moving upward (being lifted) together with the first upper punch.

In preferred embodiments of the manufacturing method for a ceramic core, the manufacturing method further includes reducing, after the pressing and before the ejecting, pressure applied to the green compact to an extent that does not cause the upper punch and the lower punch to separate from the green compact.

This configuration allows the pressure applied to the green compact to be reduced when the green compact is located within the die. This helps to reduce occurrence of spring back upon ejecting the green compact from the die. This makes it possible to reduce the likelihood of the green compact attaching to and being lifted by the first upper punch.

In preferred embodiments of the manufacturing method for a ceramic core, the lower punch has a segmented structure including a first lower punch and a second lower punch, the first lower punch corresponding to each of the flanges, the second lower punch corresponding to the axial core part, the filling includes filling the fill space with the ceramic powder by positioning the first lower punch lower than a pressing start position by a first amount of overfill, and by positioning the second lower punch lower than a pressing start position by a second amount of overfill, and transferring each of the first lower punch and the second lower punch to the pressing start position by moving the first lower punch and the second lower punch upward relative to the die. The second amount of overfill is set greater than the first amount of overfill.

This configuration makes it possible to increase the fill area corresponding to the flange during filling of the fill space with the ceramic powder. As a consequence, the ceramic powder readily enters the fill space corresponding to the flange. This allows for improved filling of the fill space corresponding to the flange with the ceramic powder, and effectively minimizes insufficient ceramic powder filling. This helps to reduce weight variations in the green compact.

In preferred embodiments of the manufacturing method for a ceramic core, the second amount of overfill is set greater than the first amount of overfill such that the upper face of the second lower punch is positioned flush with the upper face of the first lower punch or lower than the upper face of the first lower punch.

This configuration allows for increased fill space corresponding to the flange. This helps to effectively minimize insufficient filling of ceramic powder in the fill space corresponding to the flange. This results in reduced weight variations in the green compact.

The ceramic core, the wire-wound electronic component, and the manufacturing method for a ceramic core according to preferred embodiments of the present disclosure allow for increased winding area while achieving miniaturization.

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIGS. 11A to 11C are schematic cross-sectional views illustrating a manufacturing method for a ceramic core according to a second embodiment.

DETAILED DESCRIPTION

Hereinafter, embodiments of the disclosure will be described with reference to the accompanying drawings.

The accompanying drawings may in some cases illustrate components in an enlarged scale for ease of understanding. The ratios between the dimensions of different components in one given figure may differ from the actuality or from those in other figures. Further, in some cross-sectional views, some components may be indicated by hatching instead of pear-skin patterns for ease of understanding.

First Embodiment

Figure 1:
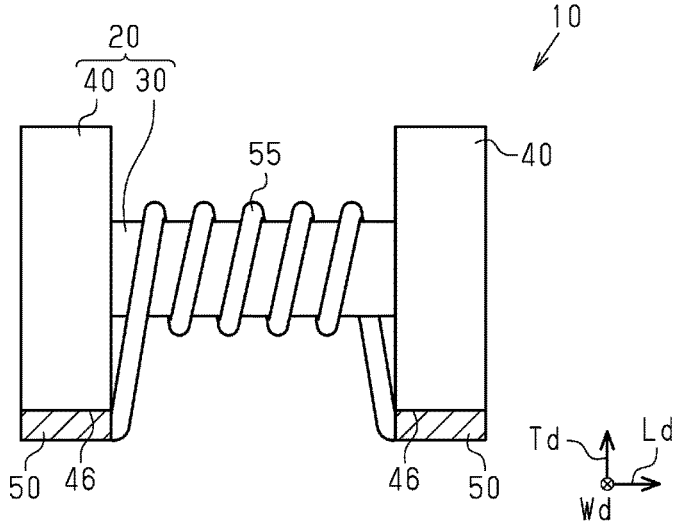
FIG. 1 is a front view of a coil component according to a first embodiment.

As illustrated in FIG. 1, a coil component 10 has a ceramic core 20, an electrode 50, and a winding (coil) 55. The ceramic core 20 is made from, for example, a ceramic material such as ferrite or alumina.

First, the structure of the ceramic core 20 will be described with reference to FIG. 2.

The ceramic core 20 has an axial core part 30, and a pair of flanges 40 located at both end portions of the axial core part 30. The axial core part 30 and the flanges 40 are formed integrally with each other.

Figure 2:
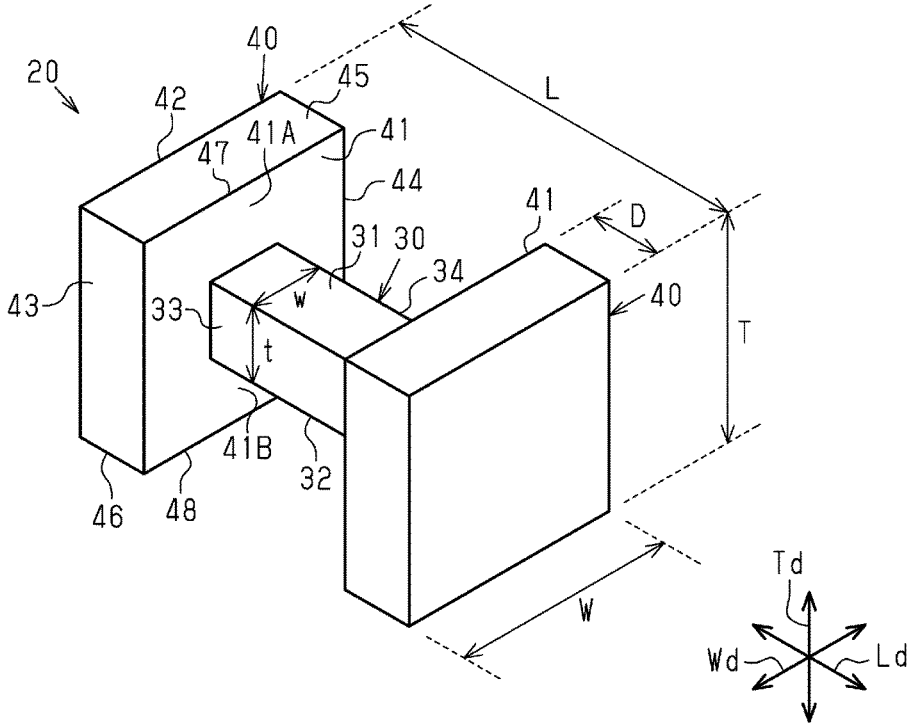
FIG. 2 is a schematic perspective view of a ceramic core according to the first embodiment.
Figure 3:
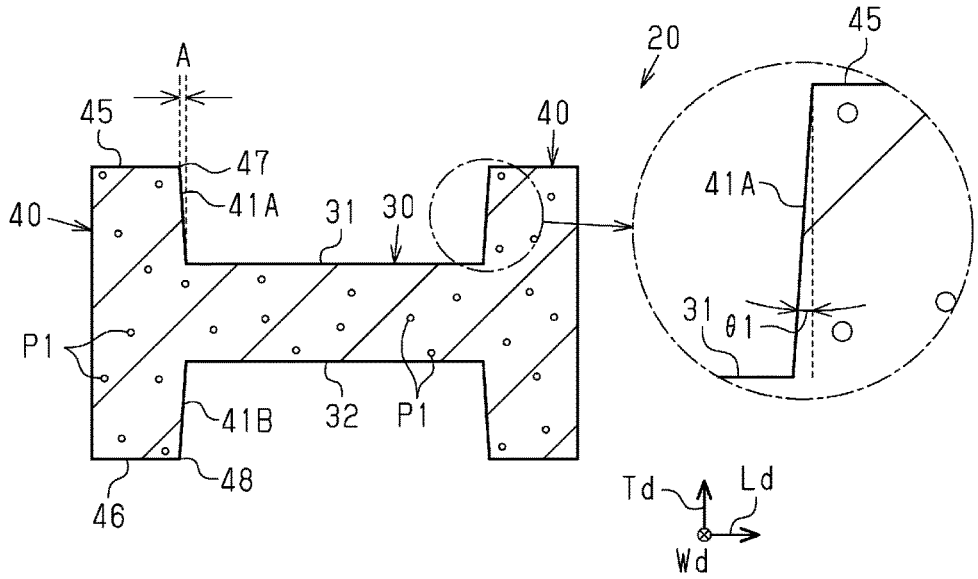
FIG. 3 is a schematic cross-sectional view of the ceramic core according to the first embodiment.

Referring to FIGS. 1 to 3, the following directions are herein defined as below. The direction in which the flanges 40 are arranged side by side is defined as "longitudinal direction Ld". Of the directions orthogonal to the "longitudinal direction Ld", the top-bottom direction in FIGS. 1 to 3 is defined as "height direction (thickness direction) Td". The direction orthogonal to both the "longitudinal direction Ld" and the "height direction Td" is defined as "width direction Wd".

The axial core part 30 is formed in, for example, a substantially rectangular parallelepiped shape extending in the longitudinal direction Ld. The center axis of the axial core part 30 extends substantially parallel to the longitudinal direction Ld. The axial core part 30 has a pair of principal faces 31 and 32 that are located opposite to each other in the height direction Td, and a pair of side faces 33 and 34 that are located opposite to each other in the width direction.

As used herein, the term "rectangular parallelepiped shape" includes a substantially rectangular parallelepiped with chamfered corners or edges, and a substantially rectangular parallelepiped with rounded corners or edges. Further, for example, irregularities may be present in part or in whole of each of the principal faces and the side faces.

The flanges 40 are located at both end portions in the longitudinal direction Ld of the axial core part 30. The flanges 40 are formed in a substantially rectangular parallelepiped shape having a relatively small size in the longitudinal direction Ld. The flanges 40 are formed so as to project around the periphery of the axial core part 30 in the height direction Td and the width direction Wd. Specifically, when viewed in the longitudinal direction Ld, the flanges 40 have a planar shape such that the flanges 40 project in the height direction Td and width direction Wd relative to the axial core part 30.

Each of the flanges 40 has a pair of principal faces 41 and 42 located opposite to each other in the longitudinal direction Ld, a pair of side faces 43 and 44 that are opposite to each other in the width direction Wd, and a pair of end faces 45 and 46 located opposite to each other in the height direction Td. The principal face 41 of each of the flanges 40 is placed opposite to the principal face 41 of the other flange 40.

The ceramic core 20 has a length dimension L in the longitudinal direction Ld of greater than about 0 mm and equal to or less than about 1.1 mm (that is, about 0 mm$<L\leq$1.1 mm). The length dimension L of the ceramic core 20 is preferably about 0 mm$<L\leq$0.85 mm, and more preferably about 0 mm$<L\leq$0.65 mm. The height dimension T in the height direction Td of the ceramic core 20 (the height dimension in the height direction Td of the flange 40) is, for example, about 0.1 mm to 0.6 mm. The width dimension W in the width direction Wd of the ceramic core 20 (the width dimension in the width direction Wd of the flange 40) is, for example, about 0.1 mm to 0.6 mm. The thickness dimension t in the height direction Td of the axial core part 30 is, for example, about 0.05 mm to 0.3 mm. The width dimension w in the width direction Wd of the axial core part 30 is, for example, about 0.05 mm to 0.3 mm. The thickness dimension D in the longitudinal direction Ld of the flange 40 is, for example, about 0.08 mm to 0.15 mm.

A ratio t/T, which is the ratio of the thickness dimension t of the axial core part 30 to the height dimension T of the flange 40, is about $0<t/T\leq 0.6$. The ratio t/T is preferably in the range of about 0.1 to 0.6, and more preferably in the range of about 0.2 to 0.5. Further, a ratio w/W, which is the ratio of the width dimension w of the axial core part 30 to the width dimension W of the flange 40, is about $0<w/W\leq 0.6$. The ratio w/W is preferably in the range of about 0.1 to 0.6, and more preferably in the range of about 0.2 to 0.5. Setting the ratio t/T equal to or less than about 0.6 allows for increased size of the step between the axial core part 30 and the flange 40 in the height direction, and setting the ratio w/W equal to or less than about 0.6 allows for increased size of the step between the axial core part 30 and the flange 40 in the width direction Wd. This ensures that the ceramic core 20 has a large winding area.

The principal face 41 of each of the flanges 40 is formed such that the entirety of the principal face 41 extends substantially perpendicular to the direction in which the center axis of the axial core part 30 extends (that is, the longitudinal direction Ld). That is, the principal face 41 of each of the flanges 40 is formed such that the entirety of the principal face 41 extends substantially parallel to the height direction Td. In other words, the principal face 41 of each of the flanges 40 is provided with substantially no inclination.

The principal faces 31 and 32 of the axial core part 30, the end faces 45 and 46 of the flange 40, and a part of the principal face 41 of the flange 40 constitute the punch faces of the ceramic core 20 (that is, the faces of the ceramic core 20 that come into contact with the punches during compaction). The remaining surfaces of the ceramic core 20 constitute die faces (that is, the faces of the ceramic core 20 that come into contact with the die during compaction). In more detail, faces 41A and 41B, which are substantially strip-shaped portions of the principal face 41 respectively extending in the height direction Td from the principal faces 31 and 32 of the axial core part 30, constitute the punch faces. Specifically, the face 41A is a substantially strip-shaped face that connects an end portion in the longitudinal direction Ld of the principal face 31 of the axial core part 30, with a part of an edge portion 47, which is the boundary portion between the end face and the principal face 41. Further, the face 41B is a substantially strip-shaped face that connects an end portion in the longitudinal direction Ld of the principal face 32 of the axial core part 30, with a part of an edge portion 48, which is the boundary portion between the end face 46 and the principal face 41. The faces 41A and 41B mentioned above are formed so as to extend substantially parallel to the height direction Td. In other words, each of the faces 41A and 41B is formed substantially parallel to the other portions of the principal face 41.

The inclination angle θ1 of the faces 41A and 41B illustrated in FIG. 3 is preferably equal to or less than about 5°, more preferably equal to or less than about 3°, and further more preferably equal to or less than about 0°. The inclination angle θ1 represents the angle formed between the plane extending perpendicular to the direction in which the center axis of the axial core part 30 extends (that is, the longitudinal direction Ld) (the plane parallel to the height direction Td), and the face 41A (face 41B). A dimension "A" is preferably equal to or less than about 10 μm, and more preferably equal to or less than about 5 μm. The dimension A represents the dimension in the longitudinal direction Ld from the edge portion 47 (edge portion 48) of the face 41A (face 41B) to the end portion in the longitudinal direction Ld of the principal face 31 (principal face 32). FIG. 3 is a schematic cross-sectional view taken along the center axis of the axial core part 30 illustrated in FIG. 2. In FIG. 3, the inclination of the faces 41A and 41B is exaggerated to facilitate the explanation of the inclination angle θ1 and the dimension A.

Pores P1 (bubbles) are present within the axial core part 30 and the flange 40. The number of the pores P1 increases with decreases in the compaction density of each of the axial core part 30 and the flange 40. That is, the proportion of the pores P1 present varies with the compaction density of each of the axial core part 30 and the flange 40. Accordingly, if the difference in compaction density between the axial core part 30 and the flange 40 is small, then the difference between the proportion of the pores P1 present in the axial core part 30 and the proportion of the pores P1 present in the flange 40 is small. As used herein, the term "the proportion of the pores P1 present in the flange 40" refers to the total area of the pores P1 per unit area of the flange 40, and "the proportion of the pores P1 present in the axial core part 30" refers to the total area of the pores P1 per unit area of the axial core part 30.

The difference between the proportion of the pores P1 present in the flange 40 and the proportion of the pores P1 present in the axial core part 30 is preferably equal to or less than about 20%, more preferably equal to or less than about 15%, and further more preferably equal to or less than about 10%. Setting the difference between the proportion of the pores P1 present in the flange 40, and the proportion of the pores P1 present in the axial core part 30 to be equal to or less than about 20% helps to minimize decreases in the strength of the flange 40.

As illustrated in FIG. 1, the electrode 50 is disposed on the end face 46 in the height direction Td of each of the flanges 40. The electrode 50 is electrically connected to an electrode on a circuit board when the coil component 10 is mounted onto the circuit board, for example. The electrode 50 is made from, for example, an Ni-based alloy such as nickel (Ni)-chromium (Cr) or Ni-copper (Cu), silver (Ag), Cu, or tin (Sn).

The winding 55 is wound around the axial core part 30. The structure of the winding 55 is such that, for example, a core wire containing an electrically conductive material such as Cu or Ag as its main component is coated with an insulating material such as polyurethane or polyester. The winding 55 has a diameter of, for example, about 20 μm. Each end portion of the winding 55 is electrically connected to the electrode 50.

Figure 4:
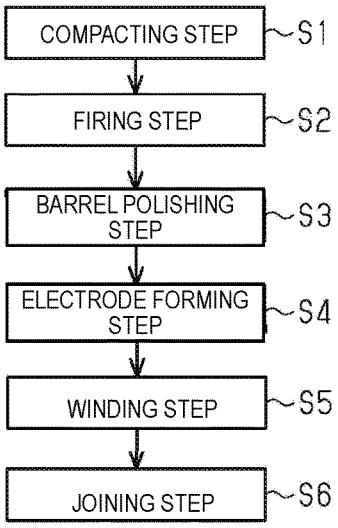
FIG. 4 is a flowchart illustrating a manufacturing method for a coil component according to the first embodiment.

Next, a manufacturing method for the coil component 10 will be described with reference to FIGS. 1 and 4.

First, a ceramic powder is compacted to form a green compact (step S1). Next, the green compact is held in a firing furnace at a predetermined temperature (about 1100° C.) for a predetermined time (for example, one hour) to fire the green compact (step S2). This firing produces a sintered compact. Subsequently, the sintered compact is charged into a barrel for polishing with an abrasive (step S3). This barrel polishing deburrs the sintered compact, giving curved roundness to the outer surface (in particular, the corners or edge portions) of the sintered compact. The above manufacturing process produces the ceramic core 20 illustrated in FIG. 2.

Subsequently, the electrode 50 is formed on the end face 46 of the flange 40 of the ceramic core 20 (step S4). For example, the electrode 50 can be formed as follows. A coating of an electrically conductive paste made of Ag or other materials is applied to the end face 46 of the flange 40, followed by baking to form an underlying metal layer. Then, a nickel (Ni)-plated film and a tin (Sn)-plated film are sequentially formed on or over the underlying metal layer by electrolytic plating to form the electrode 50.

Next, the winding 55 is wound around the axial core part 30 of the ceramic core 20 (step S5), and then an end portion of the winding 55 and the electrode 50 are joined by a known method such as thermo-compression bonding (step S6). The coil component 10 can be manufactured through the above-mentioned manufacturing process.

Next, the compaction process at step S1 will be described in detail with reference to FIGS. 5A to 9C. First, the structure of a powder compaction apparatus 60 used in the compaction process will be described.

Figure 5B:
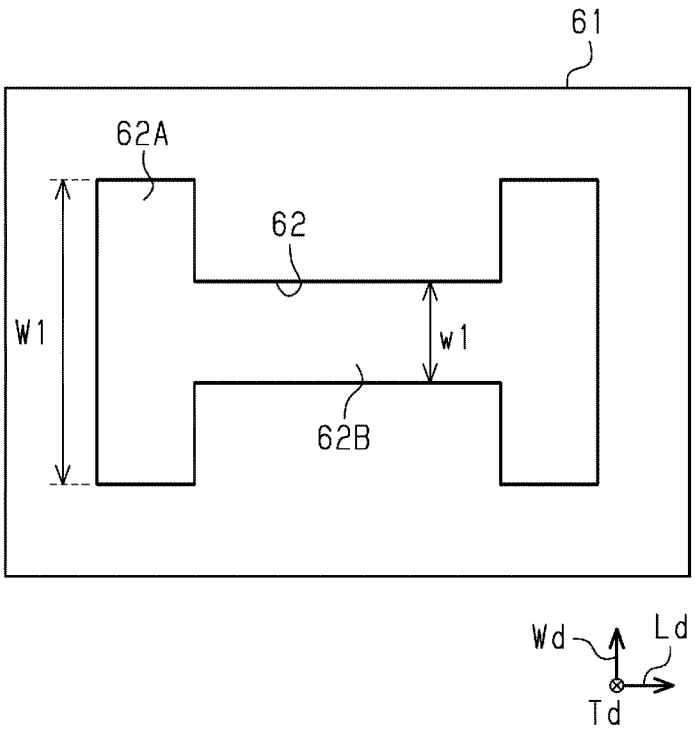
FIG. 5B is a schematic plan view of a die of the powder compaction apparatus according to the first embodiment.
Figure 5A:
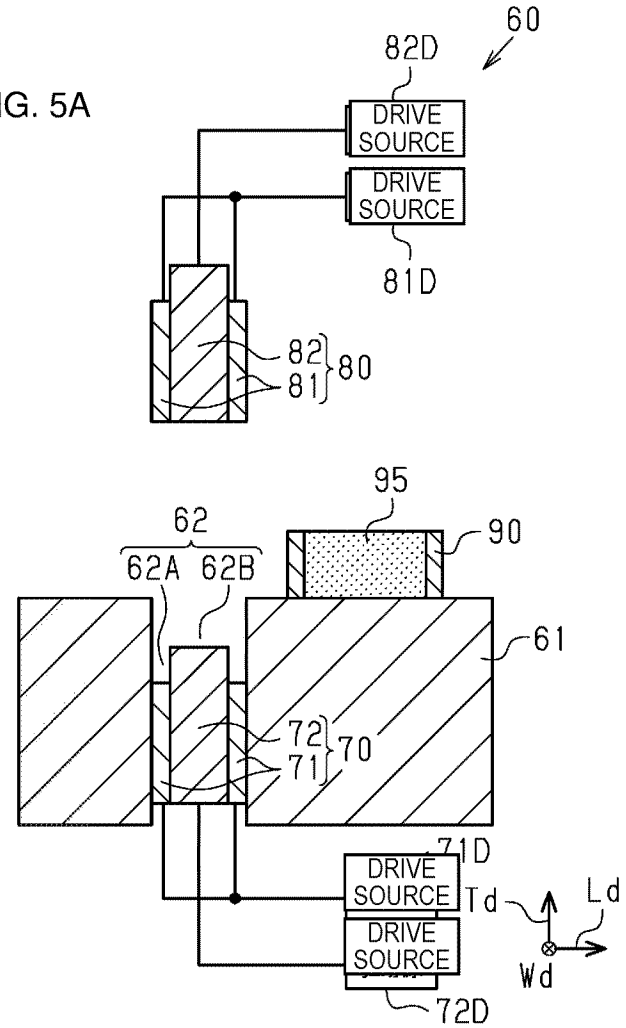
FIG. 5A is a schematic cross-sectional view of a powder compaction apparatus according to the first embodiment.

As illustrated in FIG. 5A, the powder compaction apparatus 60 has a die 61, a lower punch 70, an upper punch 80, and a feeder 90.

The die 61 has a fill cavity 62 that extends through the die 61 in the height direction Td. As illustrated in FIG. 5B, when viewed in the height direction Td, the fill cavity 62 has a substantially H-shape that is substantially identical to the shape of the ceramic core 20 illustrated in FIG. 1. That is, the fill cavity 62 has a fill portion 62A corresponding to each of the pair of flanges 40 illustrated in FIG. 1, and a fill portion 62B corresponding to the axial core part 30. In the fill cavity 62, a ratio w1/W1, which is the ratio of the width dimension w1 in the width direction Wd of the fill portion 62B to the width dimension W1 in the width direction Wd of the fill portion 62A, is set to about $0<w1/W1\leq 0.6$.

As illustrated in FIG. 5A, the lower punch 70 has a segmented structure including a first lower punch 71 corresponding to the flange, and a second lower punch 72 corresponding to the axial core part. The first lower punch 71 and the second lower punch 72 are independently driven (lowered or raised) by different drive sources 71D and 72D, respectively. The upper punch 80 has a segmented structure including a first upper punch 81 corresponding to the flange, and a second upper punch 82 corresponding to the axial core part. The first upper punch 81 and the second upper punch 82 are independently driven (lowered or raised) by different drive sources 81D and 82D, respectively. For example, servo motors can be used as the drive sources 71D, 72D, 81D, and 82D.

The feeder 90 is formed in a substantially box-like shape. The feeder 90 is disposed on the top face of the die 61 in such a way that allows the feeder 90 to slide on the top face in the left-right direction (the longitudinal direction Ld).

The powder compaction apparatus 60 has a plurality of pairs of upper and lower punches including a pair of the first lower punch 71 and the first upper punch 81 corresponding to the flange, and a pair of the second lower punch 72 and the second upper punch 82 corresponding to the axial core part. In the powder compaction apparatus 60, the die 61 and the punches 71, 72, 81, and 82 are each driven independently. That is, the powder compaction apparatus 60 employs a multi-axial pressing system (multi-stage pressing system). The following steps are carried out by using the powder compaction apparatus 60. The following description will be directed to an example of operation for a fixed-die system in which compaction takes place with the die 61 remaining stationary.

Figures 6A, 6B, 6C:
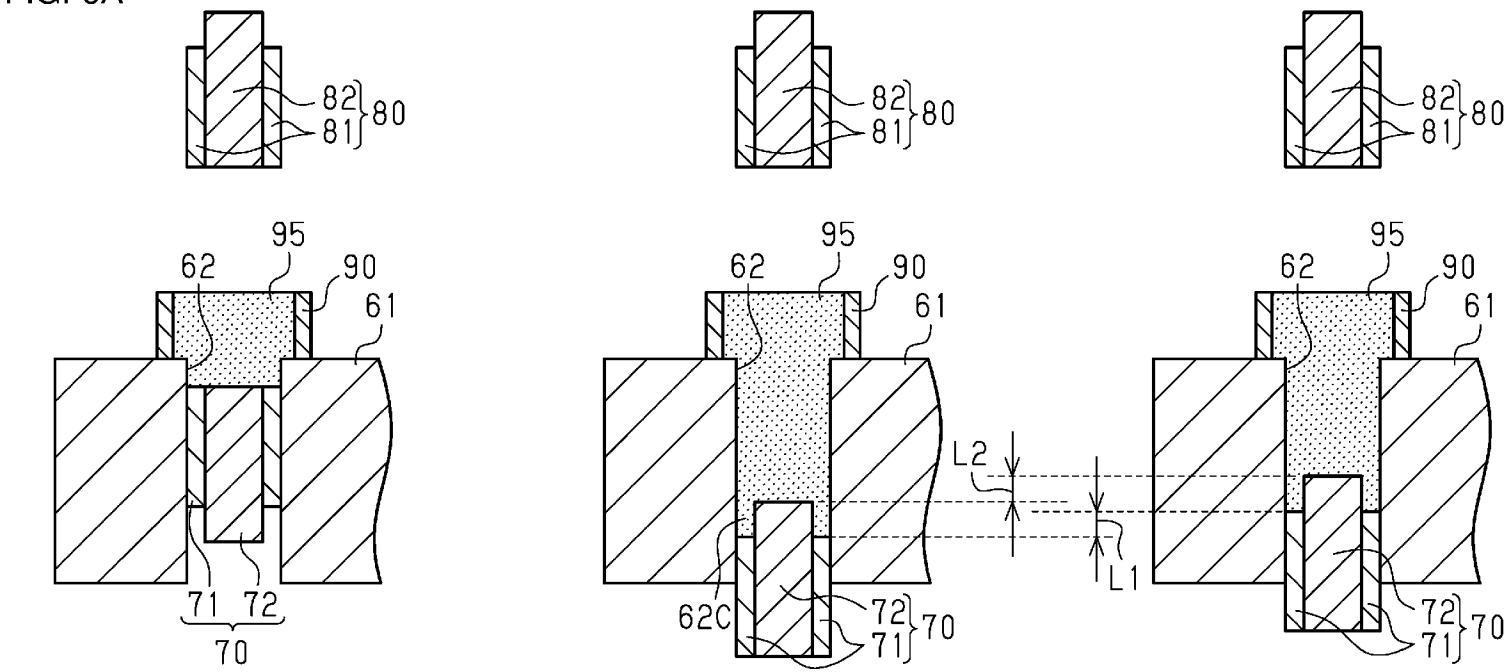
FIGS. 6A to 6C are schematic cross-sectional views illustrating the manufacturing method for a ceramic core according to the first embodiment.

First, in the step illustrated in FIG. 6A, the feeder 90 is moved to be positioned over the fill cavity 62.

Next, in the step illustrated in FIG. 6B, a ceramic powder 95 is fed from the cavity of the feeder 90, and the lower punch 70 is lowered relative to the die 61 by a predetermined amount. Specifically, the first lower punch 71 is moved to a position lower than the pressing start position (compression start position) by an amount of overfill L1, and the second lower punch 72 is moved to a position lower than the pressing start position by an amount of overfill L2. As a result, the ceramic powder 95 is charged from the feeder 90 into a fill space capable of receiving an amount of the ceramic powder 95 greater than the final desired amount of fill. Each of the amounts of overfill L1 and L2 is, for example, about 0.3 mm.

Subsequently, in the step illustrated in FIG. 6C, the first and second lower punches 71 and 72 are respectively moved upward relative to the die 61 by the amounts of overfill L1 and L2 to the pressing start position (overfill). This pushes an excess amount of the ceramic powder 95 back into the feeder 90, ensuring dense filling of the fill cavity 62 with the ceramic powder 95.

The overfill step illustrated in FIGS. 6B and 6C may be omitted such that each of the first lower punch 71 and the second lower punch 72 is moved to the corresponding pressing start position from the state illustrated in FIG. 6A.

Figure 7B:
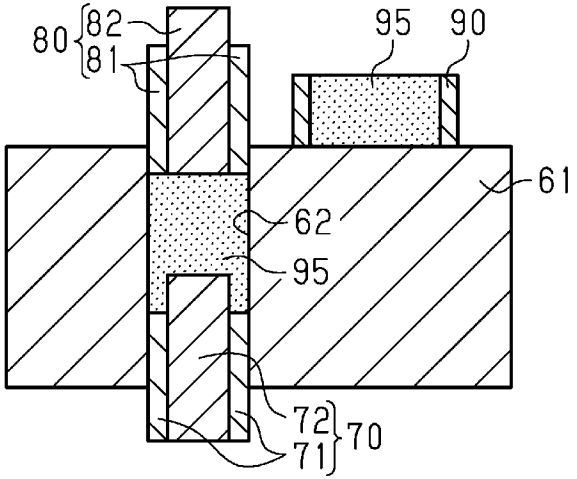
FIGS. 7A and 7B are schematic cross-sectional views illustrating the manufacturing method for a ceramic core according to the first embodiment.
Figure 7A:
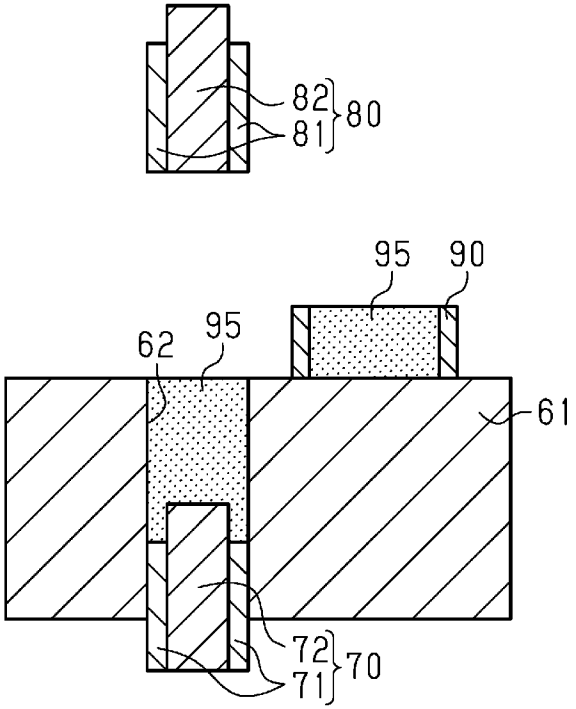

Next, in the step illustrated in FIG. 7A, the feeder 90 is retracted to the right in FIG. 7A. At this time, any portion of the ceramic powder 95 sticking out from the fill cavity 62 is levelled off with the side wall or other portions of the feeder 90.

Subsequently, in the step illustrated in FIG. 7B, the upper punch 80 is moved downward to enter the fill cavity 62. At this time, to reduce blow-out of the ceramic powder 95, the lower punch 70 may be moved downward relative to the die 61 prior to advancing the upper punch 80 into the fill cavity 62 (underfill).

Figure 8A:
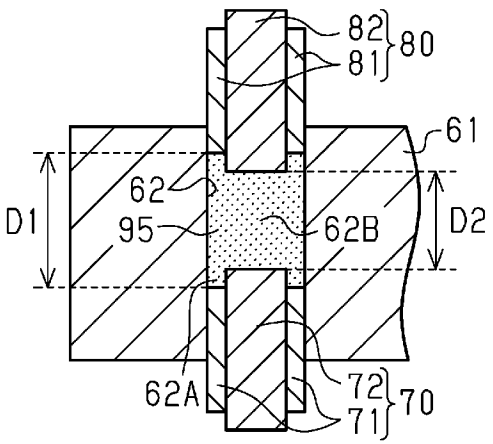
FIGS. 8A to 8C are schematic cross-sectional views illustrating the manufacturing method for a ceramic core according to the first embodiment.
Figure 8B:
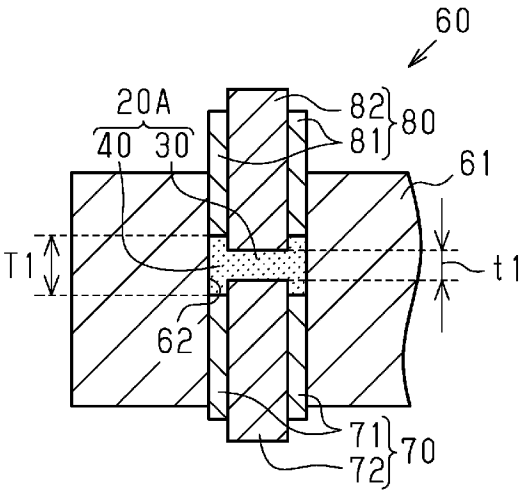

Next, in the step illustrated in FIG. 8A, each of the punches 71, 72, 81, and 82 is transferred to the pressing start position (transfer step). Subsequently, in the step illustrated in FIG. 8B, the ceramic powder 95 filled in the fill space defined by the lower punch 70, the upper punch 80, and the die 61 is pressed with the lower punch 70 and the upper punch 80 to form a green compact 20A (pressing step). For example, the first and second lower punches 71 and 72 are moved upward relative to the die 61, and the first and second upper punches 81 and 82 are moved downward relative to the die 61 to press the ceramic powder 95.

At this time, the powder compaction apparatus 60 allows each of the punches 71, 72, 81, and 82 to be driven independently, thus enabling individual control (setting) of the amount (distance) that each of the punches 71, 72, 81, and 82 moves relative to the die 61. This allows the pressing start position of each of the punches 71, 72, 81, and 82 to be adjusted individually, enabling individual adjustment of the distance that each of the punches 71, 72, 81, and 82 moves during pressing. This makes it possible to freely adjust the fill depth D1 of the ceramic powder 95 filled in the fill portion 62A between the first lower punch 71 and the first upper punch 81 in the pressing start position illustrated in FIG. 8A. This also makes it possible to freely adjust the fill depth D2 of the ceramic powder 95 filled in the fill portion 62B between the second lower punch 72 and the second upper punch 82 in the pressing start position. Further, this makes it possible to freely adjust the dimension T1 in the pressing direction (the top-bottom direction in FIG. 8B) of the flange 40 after compaction illustrated in FIG. 8B, and the dimension t1 in the pressing direction of the axial core part 30 after compaction.

In the transfer step and the pressing step according to the first embodiment, the amount of movement of each of the punches 71, 72, 81, and 82 is individually controlled such that a ratio t1/T1 is about $0<t1/T1\leq0.6$, the ratio t1/T1 being the ratio of the dimension t1 in the pressing direction of the axial core part 30 to the dimension T1 in the pressing direction of the flange 40. Further, the amount of movement of each of the punches 71, 72, 81, and 82 is individually controlled such that a ratio t/T is about $0<t/T\leq0.6$, the ratio t/T being the ratio of the thickness dimension t of the axial core part 30 after firing to the height dimension T of the flange 40 after firing. This makes it possible to form the green compact 20A with an increased size of the step between the axial core part 30 and the flange 40 in the pressing direction.

Further, in the transfer step and the pressing step, the amount of movement of each of the punches 71, 72, 81, and 82 is individually controlled such that the compression ratio R1 of the flange 40 and the compression ratio R2 of the axial core part 30 become substantially equal. In this regard, the compression ratio (compaction density) of the green compact 20A (the axial core part 30 and the flange 40) is determined by factors such as the depth of fill (or amount of fill) of the ceramic powder 95 prior to compaction, and the thickness of the green compact 20A after compaction (or the total distance moved by each of the lower punch 70 and the upper punch 80 during compaction). As used herein, the term "compression ratio" is defined as the ratio of the thickness of the green compact 20A after compaction to the fill depth of the ceramic powder 95 prior to compaction. For example, the compression ratio R1 of the flange 40 is obtained as a ratio T1/D1, which is the ratio of the dimension T1 in the pressing direction of the flange 40 to the fill depth D1 (see FIG. 8A). Further, the compression ratio R2 of the axial core part 30 is obtained as a ratio t1/D2, which is the ratio of the dimension t1 in the pressing direction of the axial core part 30 to the fill depth D2 (see FIG. 8A). The compression ratios R1 and R2 can be individually adjusted by individually controlling the amount of movement of each of the punches 71, 72, 81, and 82.

A ratio R1/R2, which is the ratio of the compression ratio R1 of the flange 40 to the compression ratio R2 of the axial core part 30, is preferably in the range of about 0.9 to 1.1, and more preferably in the range of about 0.95 to 1.05. Setting the ratio R1/R2 to be in the range of about 0.9 to 1.1 allows for reduced difference in compacting density between the axial core part 30 and the flange 40 that differ in thickness in the pressing direction.

Figure 8C:
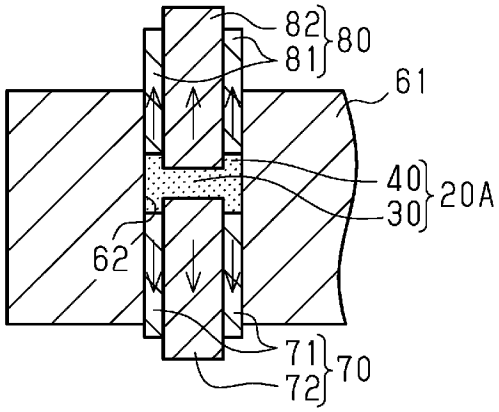

Next, in the step illustrated in FIG. 8C, after the green compact 20A is formed, applied pressure is reduced to an extent that does not cause the lower punch 70 and the upper punch 80 to separate from the green compact 20A. Specifically, the pressure applied to the green compact 20A is reduced to an extent that does not cause the lower punch 70 and the upper punch 80 to separate from the green compact 20A. This pressure reduction step is performed when the green compact 20A is located within the die 61. In this step, if pressure is reduced to an extent that causes the lower punch 70 and the upper punch 80 to separate from the green compact 20A, this causes breakage of the green compact 20A due to expansion.

Subsequently, in the step illustrated in FIG. 9A, of the two punches constituting the upper punch 80, only the second upper punch 82 corresponding to the axial core part is moved upward to separate the second upper punch 82 from the green compact 20A. That is, the second upper punch 82 is separated from the green compact 20A earlier than the first upper punch 81. This makes it possible to move the second upper punch 82 upward while keeping the lower face of the first upper punch 81 in contact with the flange 40, that is, while restricting upward movement of the green compact 20A by means of the first upper punch 81. This helps to reduce the likelihood of the green compact 20A attaching to and being lifted by the second upper punch 82.

Figure 9C:
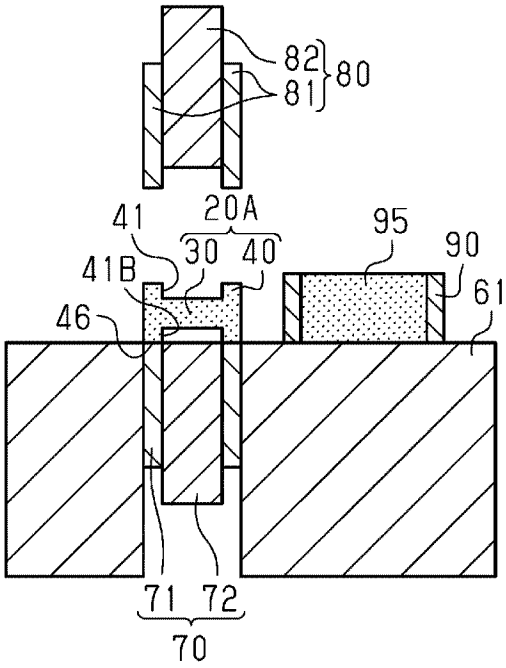
FIGS. 9A to 9C are schematic cross-sectional views illustrating the manufacturing method for a ceramic core according to the first embodiment.
Figure 9B:
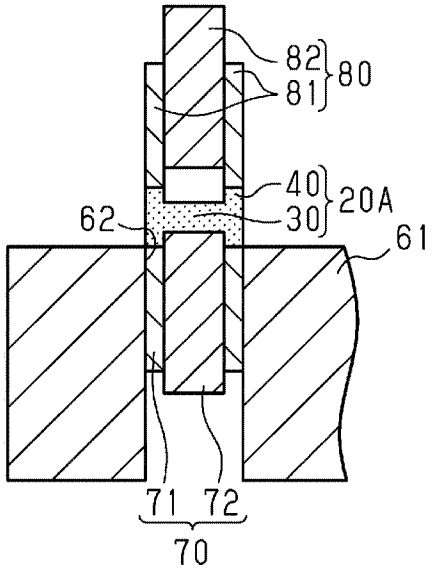

Next, in the step illustrated in FIG. 9B, the lower punch 70 and the upper punch 80 are moved upward relative to the die 61 to eject the green compact 20A from the die 61 (ejection step).

Next, in the step illustrated in FIG. 9C, the second lower punch 72 is moved downward, and the first upper punch 81 and the second upper punch 82 are moved upward (release step). As a result, the second lower punch 72 is separated from the green compact 20A, and the first upper punch 81 is separated from the green compact 20A. In this step, the timing at which to move the second lower punch 72 downward, and the timing at which to move the upper punch 80 upward are not particularly limited. For example, the upper punch 80 may be moved upward simultaneously with lowering of the second lower punch 72. Alternatively, the upper punch 80 may be moved upward after the second lower punch 72 is moved downward. Alternatively, the second lower punch 72 may be moved downward after the upper punch 80 is moved upward.

The above-mentioned step of separating the second upper punch 82 from the green compact 20A earlier than the first upper punch 81 may be performed at any time after the pressing step (see FIG. 8B) and before the release step (see FIG. 9C).

Thereafter, the feeder 90 is moved (advanced) to the left in FIG. 9C to push the green compact 20A out. As a result, the green compact 20A is collected in an external collection unit. The manufacturing process mentioned above enables manufacture of the green compact 20A that is substantially identical in shape to the ceramic core 20 illustrated in FIG. 2.

The above-mentioned manufacturing process may be also performed in substantially the same manner for the floating-die system. In the case of the floating-die system, for example, the first lower punch 71 is fixed, and the die 61, the second lower punch 72, and the upper punch 80 are moved up and down. At this time, for example, the die 61 is moved upward to effect downward movement of the first lower punch 71 relative to the die 61. Alternatively, the die 61 is moved downward to effect upward movement of the first lower punch 71 relative to the die 61.

The first embodiment mentioned above provides the following operational effects.

(1) In the case of a powder compaction apparatus 100 according to related art illustrated in FIGS. 16A to 16D, both the lower punch 103 and the upper punch 105 are uni-axial punches. Accordingly, when the axial core part 30 and the flange 40 differ in thickness in the pressing direction, the compression ratio of the flange 40, which is the thicker of the two components, becomes less than the compression ratio of the axial core part 30. This difference in compression ratio increases with increasing size of the step between the axial core part 30 and the flange 40 in the pressing direction. Accordingly, as the size of the step between the axial core part and the flange 40 in the pressing direction increases, the compaction density of the flange 40 decreases, resulting in decreased strength of the flange 40. In particular, if the ceramic core to be manufactured has a length dimension L of equal to or less than about 1.1 mm, and a ratio t/T of equal to or less than about 0.6, the strength of the flange 40 decreases significantly. This causes chipping to occur in the flange 40 during compaction, making it impossible to form a green compact. This is why it has been impossible with the powder compaction apparatus 100 according to related art to form a green compact with an increased size of the step between the axial core part 30 and the flange 40 in the pressing direction.

By contrast, with the manufacturing method according to the first embodiment, the lower punch 70, which is of a segmented structure including the first lower punch 71 corresponding to the flange and the second lower punch 72 corresponding to the axial core part, and the upper punch 80, which is of a segmented structure including the first upper punch 81 corresponding to the flange and the second upper punch 82 corresponding to the axial core part, are used to press the ceramic powder 95 filled in the die 61 to form the green compact 20A. Each of the punches 71, 72, 81, and 82 is individually driven to individually control the amount of movement of each of the punches 71, 72, 81, and 82. This allows the pressing start position of each of the punches 71, 72, 81, and 82 to be adjusted individually, enabling individual adjustment of the distance that each of the punches 71, 72, 81, and 82 moves during pressing. As a consequence, the compression ratio R1 of the flange 40, and the compression ratio R2 of the axial core part 30 can be adjusted individually. As a result, even when the size of the step between the axial core part 30 and the flange 40 in the pressing direction increases, the above configuration minimizes decreases in the compaction density of the flange 40, thus minimizing decreases in the strength of the flange 40. Therefore, the manufacturing method according to the first embodiment makes it possible to form a green compact that allows for increased size of the step between the flange 40 and the axial core part 30 in the pressing direction (that is, increased ratio t/T), even when the green compact being formed has a small size with a length dimension L of equal to or less than about 1.1 mm. This makes it possible to manufacture the ceramic core 20 that allows for increased winding area while being small in size.

(2) For the ceramic core 20, the ratio t/T is set equal to or less than about 0.6, and the ratio w/W is set equal to or less than about 0.6. This allows for increased size of the step between the axial core part 30 and the flange 40 in the height direction Td and the width direction Wd, thus ensuring a large winding area.

(3) The ability to increase the winding area in the ceramic core 20 allows for increased turn count of the winding 55 in the coil component 10. This allows the inductance of the coil component 10 to be increased. Further, the winding 55 can be increased in diameter. In this case, the direct-current resistance of the coil component 10 can be reduced.

Figure 9A:
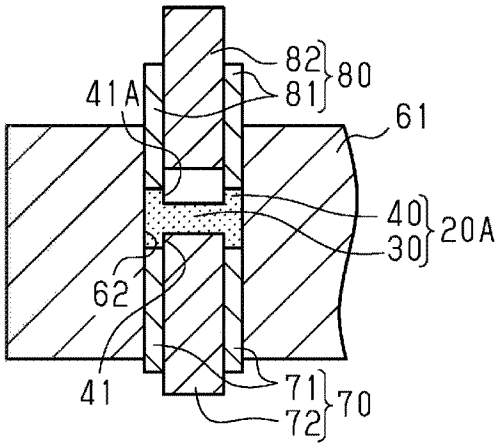

(4) Through intensive study and research, the present inventors have found that not performing the step illustrated in FIG. 9A leads to increased likelihood that the green compact 20A attaches to and is lifted by the upper punch 80. Further, the present inventors have also found that when the green compact 20A attaches to and is lifted by the upper punch 80, this leads to breakage of the lower punch 70 and the upper punch 80. This will be described in more detail below.

Figure 10C:
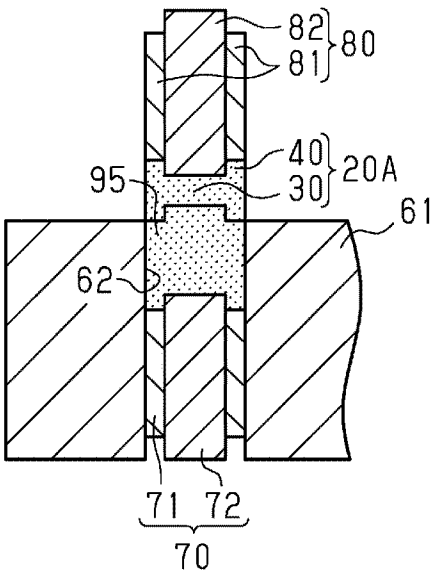
FIGS. 10A to 10C are schematic cross-sectional views illustrating a manufacturing method for a ceramic core according to a reference example.
Figure 10B:
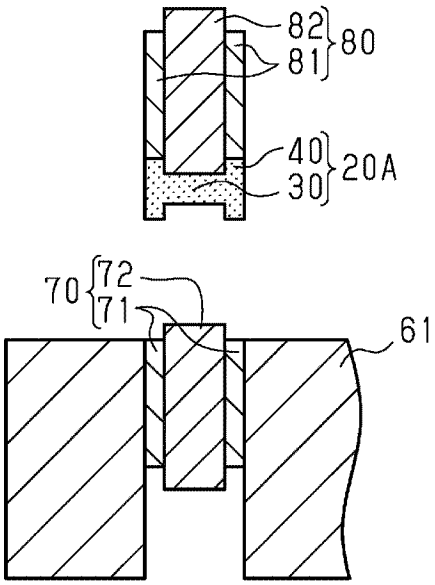
Figure 10A:
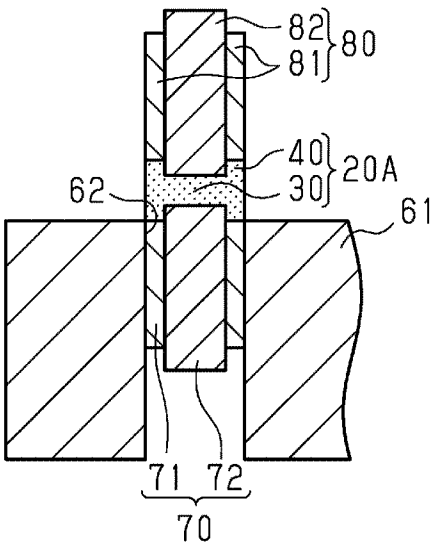

For example, as illustrated in FIG. 10A, the lower punch 70 and the upper punch 80 are moved upward after compaction to eject the green compact 20A from the die 61. When the first upper punch 81 and the second upper punch 82 are then simultaneously moved upward as illustrated in FIG. 10B, the green compact 20A is likely to attach to and be lifted by the upper punch 80. This is presumed to be due to the small size and weight of the green compact 20A. If pressing (compression) of the next workpiece is performed with the green compact 20A attaching to the upper punch 80 as mentioned above, the green compact 20A that remains attached to the upper punch 80 undergoes compression again. At this time, as illustrated in FIG. 10C, the amount of the ceramic powder 95 placed between the lower punch 70 and the upper punch 80 becomes about twice the desired amount of fill. This results in excessive load being exerted on the lower punch 70 and the upper punch 80 during pressing, leading to breakage of the lower punch 70 and the upper punch 80. This makes it impossible for the powder compaction apparatus 60 to successively form green compacts 20A. The above-mentioned problem arises specifically as a result of the decreased size and weight of the green compact 20A.

By contrast, with the manufacturing method according to the first embodiment, only the second upper punch 82 of the upper punch 80 is first separated from the green compact 20A after the compaction process. This results in decreased area of contact between the green compact 20A and the entire upper punch at the time when the remaining first upper punch 81 is separated from the green compact 20A (see FIG. 9C). This effectively reduces the likelihood of the green compact 20A attaching to and being lifted by the first upper punch 81. As a result, breakage of the punches 71, 72, 81, and 82 can be minimized. This enables successive formation of green compacts 20A, which proves advantageous in terms of manufacturing efficiency.

(5) After the compaction and before the ejection of the green compact 20A from the die 61, the pressure applied by each of the lower punch 70 and the upper punch 80 is reduced to an extent that does not cause the lower punch 70 and the upper punch 80 to separate from the green compact 20A. That is, the pressure applied by the lower punch 70 and the upper punch 80 is reduced when the green compact 20A is located within the die 61. This can reduce spring back occurring upon ejection of the green compact 20A from the die 61. This helps to reduce the likelihood of the green compact 20A attaching to and being lifted by the first upper punch 81 when the first upper punch 81 is separated from the green compact 20A.

Figures 16A, 16B, 16C, 16D:
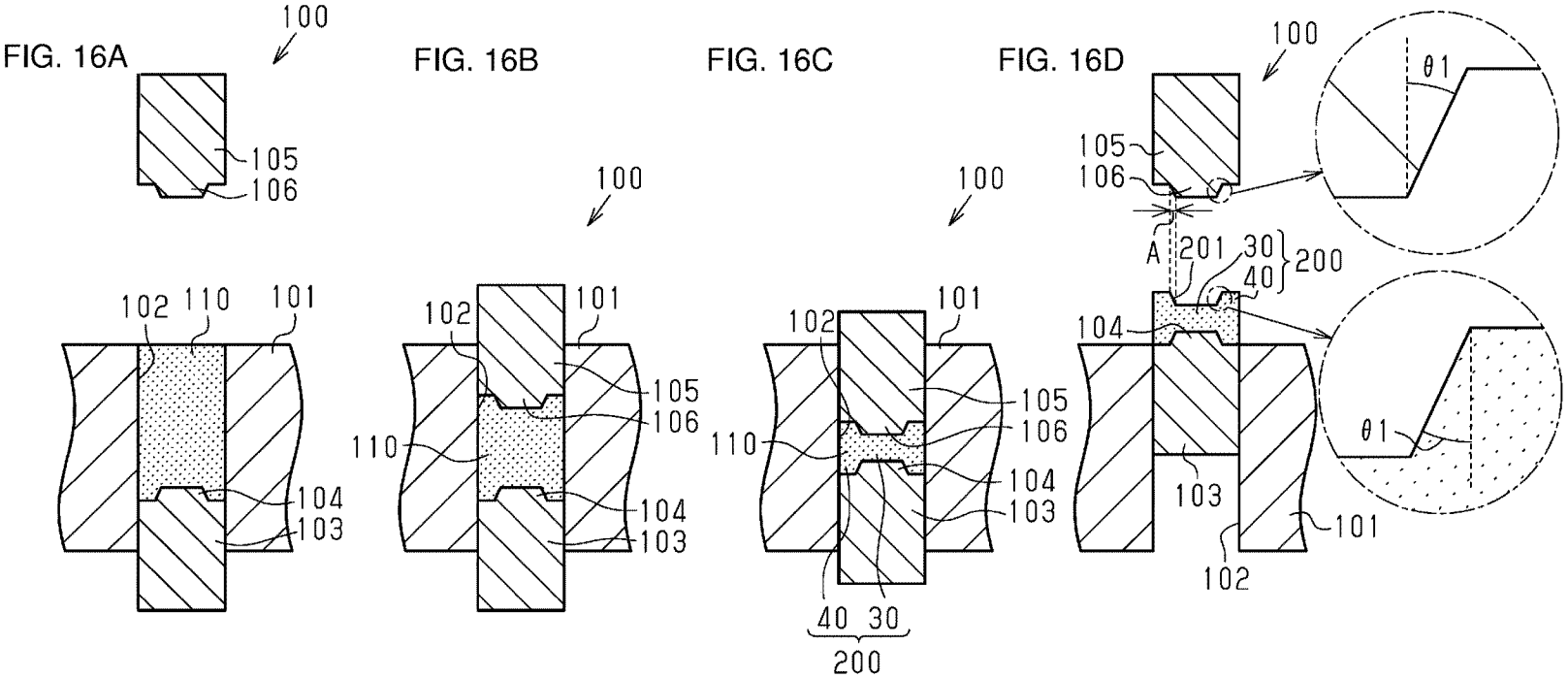
FIGS. 16A to 16D are schematic cross-sectional views illustrating a manufacturing method for a ceramic core according to related art.

(6) With the powder compaction apparatus 100 according to related art, to separate the upper punch 105 from the green compact 200, a projection 106 of the upper punch 105 corresponding to the axial core part 30 needs to have an inclined (tapered) side face as illustrated in FIG. 16D. For example, to form the green compact 200 with a length dimension L of equal to or less than about 1.1 mm and a ratio t/T of about 0.63, the inclination angle θ1 of the side face (inclined face) of the projection 106 needs to be set equal to or greater than about 10°. Since a principal face 201 of the flange 40 is formed along the inclined face of the projection 106, the principal face 201 of the flange 40 is provided with an inclined face in this case. The inclination angle θ1 of this inclined face is equal to or greater than about 10°.

By contrast, according to the first embodiment, the first upper punch 81 corresponding to the flange, and the second upper punch 82 corresponding to the axial core part are driven individually, and after compaction, only the second upper punch of the upper punch 80 is first separated from the green compact 20A. This allows the second upper punch 82 to be moved upward while keeping the lower face of the first upper punch 81 in contact with the flange 40, that is, while restricting upward movement of the green compact 20A by means of the first upper punch 81. This configuration makes it possible to, even with substantially no inclination provided to the side face of the second upper punch 82, reduce the likelihood of the green compact 20A attaching to and being lifted by the second upper punch 82, allowing the second upper punch 82 to be effectively separated from the green compact 20A. Therefore, the substantially strip-shaped face 41A, which constitutes the punch face of the principal face 41 of the flange 40 (that is, the face that comes into contact with the second upper punch 82 during compaction), can be formed so as to extend substantially parallel to the direction of ejection (the top-bottom direction in the drawings), even with substantially no inclination provided to the face 41A. For example, the face 41A can be formed with an inclination angle θ1 smaller than the inclination angle θ1 (for example, 10°) in the green compact 200 mentioned above. The resulting absence of or reduced inclination of the face 41A ensures a correspondingly larger winding area.

(7) The amount of movement of each of the punches 71, 72, 81, and 82 is individually controlled such that the compression ratio R1 of the flange 40 and the compression ratio R2 of the axial core part 30 become substantially equal. This positively contributes to reduced difference in compaction density between the axial core part 30 and the flange 40 that differ in thickness in the pressing direction.

Second Embodiment

A second embodiment of the disclosure will be described below with reference to FIGS. 11A to 11C. The following description will focus on differences from the first embodiment.

In the compaction process according to the second embodiment, during the filling step of filling the fill cavity 62 with the ceramic powder 95, the amount of overfill L2 for the second lower punch 72 corresponding to the axial core part is set greater than the amount of overfill L1 for the first lower punch 71 corresponding to the flange.

First, the feeder 90 is moved to be positioned over the fill cavity 62 as illustrated in FIG. 11A. Next, in the step illustrated in FIG. 11B, the punches 71 and 72 are moved downward relative to the die 61 such that the first lower punch 71 is positioned lower than the pressing start position by the amount of overfill L1, and the second lower punch 72 is positioned lower than the pressing start position by the amount of overfill L2 (>L1). For example, as illustrated in FIG. 11B, the amounts of overfill L1 and L2 are set such that the upper face of the second lower punch 72 becomes flush with the upper face of first lower punch 71. This makes it possible to eliminate a narrow space 62C illustrated in FIG. 6B that is enclosed by the side face of the second lower punch 72, the upper face of the first lower punch 71, and the inner side face of the fill cavity 62, that is, the space 62C that the ceramic powder 95 does not readily enter. In other words, the fill space corresponding to the flange 40 can be enlarged as illustrated in FIG. 11B. Accordingly, the ceramic powder 95 readily enters the entire fill space enclosed by the upper face of the first lower punch 71, the upper face of the second lower punch 72, and the inner side face of the fill cavity 62. This effectively ensures that the fill portion 62A corresponding to the flange 40 can be filled with an amount of the ceramic powder greater than a desired amount of fill. This helps to effectively minimize insufficient filling of the ceramic powder 95 in the fill portion 62A.

The amount of overfill L1 can be set to, for example, about 0.3 mm, and the amount of overfill L2 of the second lower punch 72 can be set to, for example, about 0.8 mm. Alternatively, in this step, the amounts of overfill L1 and L2 may be set such that the upper face of the second lower punch 72 is located below the upper face of the first lower punch 71.

Next, in the step illustrated in FIG. 11C, the first lower punch 71 is moved upward relative to the die 61 by the amount of overfill L1, and the second lower punch 72 is moved upward relative to the die 61 by the amount of overfill L2. This causes each of the first lower punch 71 and the second lower punch 72 to move to the pressing start position. In this step, the distance moved by the second lower punch 72 is greater than the distance moved by the first lower punch 71 by an amount equal to the difference between the amount of overfill L1 and the amount of overfill L2.

Thereafter, the steps illustrated in FIGS. 7A to 9C are performed to form the green compact 20A (see FIG. 9C).

The overfill operation illustrated in FIGS. 11B and 11C helps to minimize insufficient filling of the fill portion 62A at the time when the fill cavity 62 is filled with the ceramic powder 95, thus ensuring dense filling of the ceramic powder 95 in the fill portion 62A. This makes it possible to reduce the possibility of the amount of the ceramic powder 95 filled in the fill portion 62A becoming less than a desired amount. As a consequence, the difference between the compaction density of the axial core part 30 and the compaction density of the flange can be reduced. Further, weight variations in the green compact 20A (see FIG. 9C) can be reduced. This results in reduced variations in the dimensions of the ceramic core 20 after firing.

Third Embodiment

Hereinafter, a third embodiment of the disclosure will be described with reference to FIGS. 12 and 13. The following description will focus on differences from the first embodiment.

Figure 12:
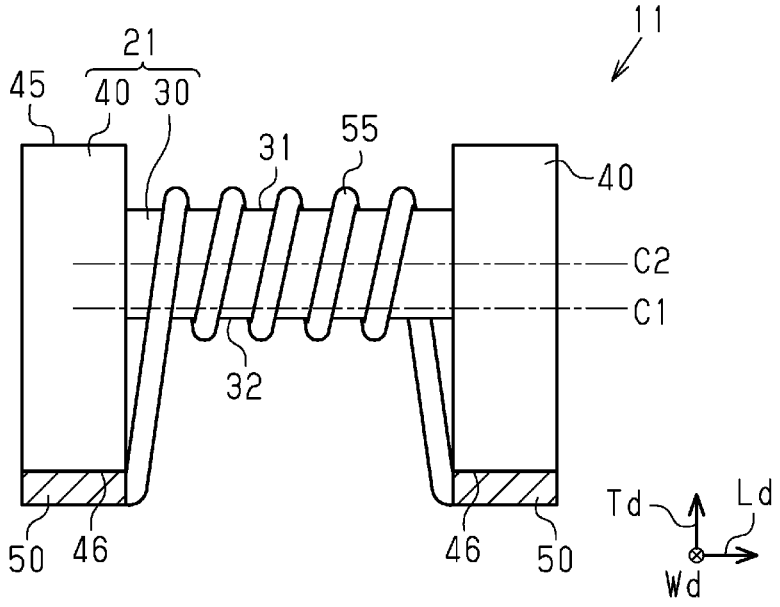
FIG. 12 is a front view of a coil component according to a third embodiment.

As illustrated in FIG. 12, a coil component 11 has a ceramic core 21, the electrode 50, and the winding 55.

Figure 13:
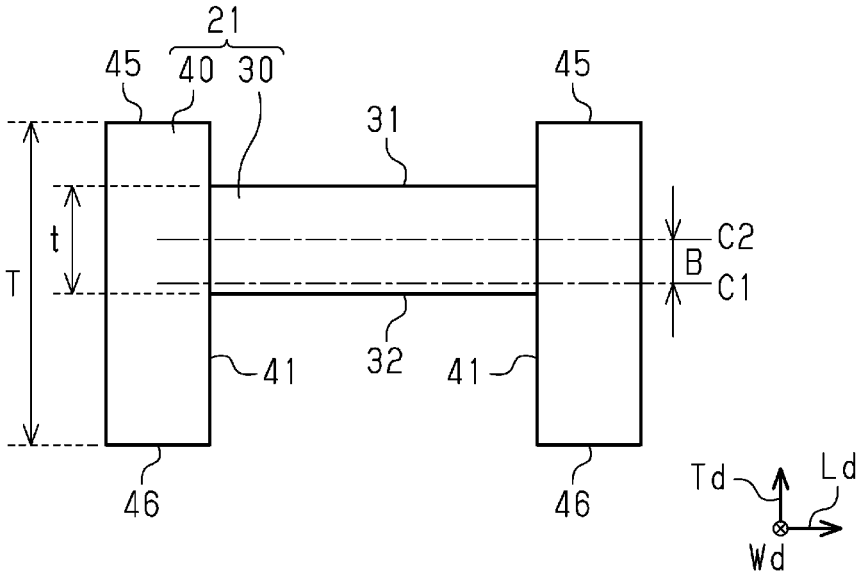
FIG. 13 is a front view of a ceramic core according to the third embodiment.

As illustrated in FIG. 13, the axial core part 30 of the ceramic core 21 is located at a position displaced from the center C1 in the height direction Td of the flange 40 (the ceramic core 21). Specifically, the center C2 in the height direction Td of the axial core part 30 is displaced relative to the center C1 in the height direction Td of the flange 40. For example, the axial core part 30 is offset toward the end face 45 with respect to the center C1 of the flange 40. The amount of displacement B between the center C2 of the axial core part 30 and the center C1 of the flange 40 can be set to, for example, about 0.01 to 0.025 mm.

As illustrated in FIG. 12, the electrode 50 is formed on the end face 46 of the flange 40. That is, the electrode 50 is formed on the end face 46, which is located opposite to the direction in which the axial core part 30 is offset with respect to the center C1 (upward in FIG. 12). This allows for greater clearance between the axial core part 30 and the electrode 50 than when the center C2 of the axial core part 30 aligns with the center C1 of the flange 40. This ensures increased area for forming the electrode 50. This also allows for increased clearance between the winding 55 (coil) wound around the axial core part 30, and the electrode 50. This helps to effectively minimize shortings between the winding 55 wound around the axial core part 30, and the electrode 50. The above configuration also allows the winding 55 wound around the axial core part 30 to be positioned at a greater distance from the circuit pattern on the circuit board when the coil component 11 is mounted on the circuit board. This has the effect of reducing occurrence of eddy current induced in the circuit pattern by the winding 55 of the coil component 11. This makes it possible to minimize increases in eddy-current loss, and consequently minimize decreases in Q-value.

The coil component 11 described above can be manufactured by, for example, a manufacturing method substantially identical to the manufacturing method according to the first embodiment or the manufacturing method according to the second embodiment. For example, a green compact substantially identical in shape to the ceramic core 20 illustrated in FIG. 13 can be manufactured by changing the distance moved by the second lower punch 72 and the distance moved by the second upper punch 82 in the step illustrated in FIG. 8B, that is, in the step of compacting the ceramic powder 95. In other words, the manufacturing methods according to the first and second embodiments allows the axial core part 30 to be freely adjusted in position in the height direction Td simply by changing the distance moved by the second lower punch 72 and the distance moved by the second upper punch 82.

Fourth Embodiment

Hereinafter, a fourth embodiment of the disclosure will be described with reference to FIGS. 14 and 15. The following description will focus on differences from the first embodiment.

Figure 14:
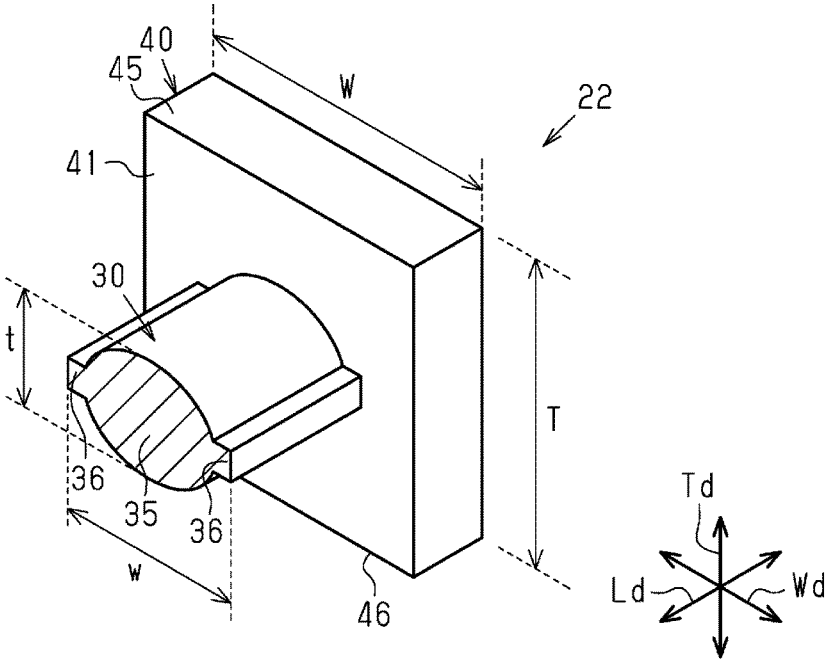
FIG. 14 is a cross-sectional perspective view of a ceramic core according to a fourth embodiment.

As illustrated in FIG. 14, the axial core part 30 of a ceramic core 22 has a substantially elliptical shape when viewed in cross-section taken orthogonal to the center axis (the longitudinal direction Ld) of the axial core part 30. Specifically, when viewed in cross-section taken orthogonal to the center axis of the axial core part 30, the axial core part has a substantially elliptical body portion 35, and a substantially rectangular projection 36 that projects outward from each end portion in the width direction Wd of the body portion 35. The projection 36 is provided to prevent breakage of the punches during the manufacturing process.

With the ceramic core 22 according to the fourth embodiment, the cross-section of the axial core part 30 taken orthogonal to the longitudinal direction Ld is substantially elliptical. This allows the winding 55 (see FIG. 1) to be easily wound around the axial core part 30, and also helps to reduce breaks in the winding 55 at the time when the winding 55 is wound.

As in the embodiments mentioned above, the ratio t/T, which is the ratio of the maximum dimension t in the height direction Td of the axial core part 30 to the height dimension T of the flange 40, is about $0<t/T\leq 0.6$. Further, as in the embodiments mentioned above, the ratio w/W, which is the ratio of the maximum dimension w in the width direction Wd of the axial core part 30 to the width dimension W of the flange 40, is also about $0<w/W\leq 0.6$.

Figure 15:
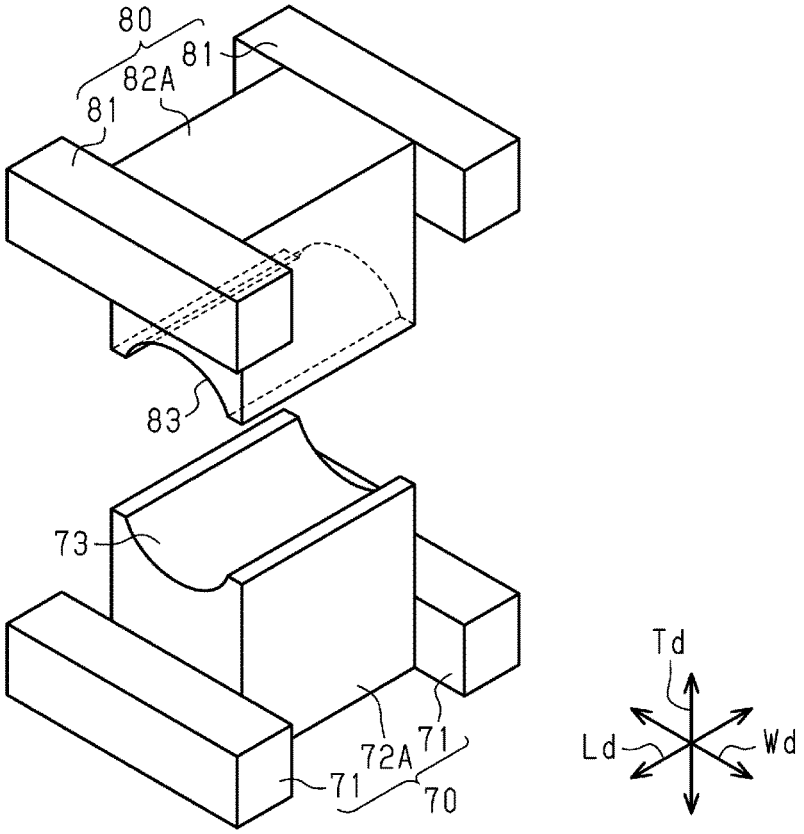
FIG. 15 is a schematic perspective view of a powder compaction apparatus according to the fourth embodiment.

The ceramic core 22 described above can be manufactured by using, for example, the lower punch 70 and the upper punch 80 illustrated in FIG. 15. The lower punch 70 is a segmented punch including the first lower punch 71 corresponding to the flange, and a second lower punch 72A corresponding to the axial core part. The upper face of the second lower punch 72A is provided with a groove 73 whose inner face is formed as a concave cylindrical face corresponding to the body portion 35 of the axial core part 30. The upper punch 80 is a segmented punch including the first upper punch 81 corresponding to the flange, and a second upper punch 82A corresponding to the axial core part. The lower face of the second upper punch 82A is provided with a groove 83 whose inner face is formed as a concave cylindrical face corresponding to the body portion 35 of the axial core part 30.

Other Embodiments

The embodiments mentioned above may be modified as appropriate to be implemented as follows.

In the fourth embodiment mentioned above, the cross-section of the body portion 35 taken orthogonal to the longitudinal direction Ld has a substantially elliptical shape. Alternatively, the cross-section of the body portion 35 taken orthogonal to the longitudinal direction Ld may have a substantially circular shape.

In the fourth embodiment mentioned above, the upper and lower punches corresponding to the axial core part 30 are implemented as the pair of the second lower punch 72A and the second upper punch 82A. However, this is not to be construed restrictively. For example, the second lower punch 72A and the second upper punch 82A may each be implemented as a punch segmented into a portion corresponding to the body portion 35 and a portion corresponding to the projection 36.

In each of the embodiments mentioned above, the planar shape of the flange 40 when viewed in the longitudinal direction Ld is substantially a rectangle. However, this is not to be construed restrictively. For example, the planar shape of the flange 40 when viewed in the longitudinal direction Ld may be substantially a polygon other than a rectangle.

In each of the embodiments mentioned above, the shape of the flange 40 may be modified such that the flange 40 is chamfered at the edge portion 48 of the end face 46 on which the electrode 50 is formed. This helps to reduce breaks in the winding 55 at the time when an end portion of the winding 55 is joined to the electrode 50 by thermo-compression bonding or other methods.

Although each of the embodiments mentioned above is implemented in the coil component 10 or 11 including the ceramic core 20, 21, or 22, each of these embodiments may be implemented in a wire-wound electronic component (for example, an antenna) other than a coil component.

The position at which to form the electrode 50 according to each of the embodiments mentioned above may be modified as appropriate. For example, the electrode 50 may be formed on each of the side faces 43 and 44 (die faces) of the flange 40.

In each of the above-mentioned embodiments other than the second embodiment, the lower punch 70 may have a single pressing axis (may be a uni-axial pressing punch) as in the lower punch 103 according to related art. In this case as well, the same effects as those described above in the sections (1) to (7) of the first embodiment can be obtained.

The above-mentioned embodiments and their modifications may be combined as appropriate.

EXAMPLES

Next, the embodiments mentioned above will be described with additional specificity and detail with reference to Examples and Comparative Examples.

Examples 1 to 10

The ceramic core 20 is produced by the manufacturing method according to the first embodiment. The ceramic powder 95 as a raw powder is prepared as follows. First, a Ni—Zn—Cu ferrite raw material is prepared, and an organic binder, a dispersant, and pure water are added to produce a slurry. Next, after the produced slurry is dried/granulated with a spray drier, the resulting slurry is passed through a sieve with an aperture of about 0.18 mm to adjust its average particle diameter D50 to about 50 μm, thus producing the ceramic powder 95.

The ratio w1/W1 of the width dimension w1 of the fill portion 62B to the width dimension W1 of the fill portion 62A illustrated in FIG. 5B is set to about 0.5, and each of the amounts of overfill L1 and L2 in the steps illustrated in FIGS. 6B and 6C are each set to about 0.3 mm. Further, the respective target values (design values) of the length, width, and height dimensions L, W, and T of the ceramic core 20, the thickness dimension D of the flange 40, and the width and thickness dimensions w and t of the axial core part 30 are varied to produce 10 kinds (Examples 1 to 10) of ceramic cores 20 with the ratio t/T set equal to or less than about 0.6. At this time, the target value of the length dimension L is set equal to or less than about 0.85 mm, and the target value of the thickness dimension D of the flange 40 is set equal to or less than about 0.15 mm.

Example 11

The ceramic core 20 is produced by the manufacturing method according to the second embodiment. The amount of overfill L1 of the first lower punch 71 is set to about 0.3 mm, and the amount of overfill L2 of the second lower punch 72 is set to about 0.8 mm. The target values of various dimensions of the ceramic core 20 are set to the same values as those in Example 5. The manufacturing method and the manufacturing conditions employed are otherwise the same as those in Examples 1 to 10.

Example 12

The ceramic core 21 according to the third embodiment is produced by the manufacturing method according to the first embodiment. At the time of compacting the ceramic powder 95 filled in the fill cavity 62, the distances moved by the second lower punch 72 and the second upper punch 82 are adjusted such that the amount of displacement B between the center C1 of the flange 40 and the center C2 of the axial core part 30 becomes equal to about 0.025 mm. The target values of various dimensions of the ceramic core 20 are set to the same values as those in Example 5. The manufacturing method and the manufacturing conditions employed are otherwise the same as those in Examples 1 to 10.

Comparative Example 1

A ceramic core with the ratio t/T set to about 0.63 and the ratio w/W set to about 0.5 is produced as follows by using the powder compaction apparatus 100 illustrated in FIGS. 16A to 16D.

First, a green compact is produced through the steps illustrated in FIGS. 16A to 16D. At this time, the same ceramic powder as the ceramic powder 95 according to each of Examples 1 to 12 is used, and also the fill cavity 102 is formed in the same shape as that according to each of Examples 1 to 12. Next, the green compact is subjected to firing and barrel polishing under the same conditions as those according to each of Examples 1 to 12 to produce a sample (ceramic core) according to Comparative Example 1.

Comparative Example 2

The powder compaction apparatus 100 according to related art is used to produce a ceramic core with the ratio t/T set to about 0.59. The target values of various dimensions of the ceramic core are set to the same values as those in Example 5. The manufacturing method and the manufacturing conditions employed are otherwise the same as those in Comparative Example 1.

Measurement Conditions

Various dimensions of samples (ceramic cores) according to Examples 1 to 12 and Comparative Examples 1 and 2 are measured under the following conditions. Specifically, in each of Examples 1 to 12 and each of Comparative Examples 1 and 2, 10 samples are taken from among produced samples, and the Digital Microscope VHX-5000 (manufactured by KEYENCE CORPORATION) is used to measure the length dimension L, the width dimension W, the height dimension T, the thickness dimension D, the thickness dimension t, the width dimension w, and the amount of displacement B for each of these samples. Then, the mean of the samples is calculated for each of the measured dimensions. The results are presented in Table 1.

The "Ratio t/T" in Table 1 is a value calculated from the mean of the measured height dimensions T and the mean of the measured thickness dimensions t, and the "Ratio w/W" is a value calculated from the mean of the measured width dimensions W and the mean of the measured width dimensions w. Further, the "Compaction success/fail" in Table 1 indicates whether a desired green compact is successfully formed under the above-mentioned conditions. The dimensions used in Comparative Example 2 for which this field indicates "Fail" are target values (design values) and not actually measured values.

TABLE 1

| | Length L (mm) | Width W (mm) | Height T (mm) | Flange thickness D (mm) | Axial core part width w (mm) | Axial core part thickness t (mm) | Ratio t/T | Ratio w/T | Displacement B (mm) | Compaction success/ fail |
|---|---|---|---|---|---|---|---|---|---|---|
| Example 1 | 0.85 | 0.46 | 0.46 | 0.12 | 0.23 | 0.271 | 0.59 | 0.5 | 0 | Success |
| Example 2 | 0.79 | 0.46 | 0.46 | 0.12 | 0.23 | 0.271 | 0.59 | 0.5 | 0 | Success |
| Example 3 | 0.79 | 0.46 | 0.46 | 0.12 | 0.23 | 0.193 | 0.42 | 0.5 | 0 | Success |
| Example 4 | 0.60 | 0.42 | 0.42 | 0.11 | 0.21 | 0.247 | 0.59 | 0.5 | 0 | Success |
| Example 5 | 0.51 | 0.38 | 0.38 | 0.095 | 0.19 | 0.225 | 0.59 | 0.5 | 0 | Success |
| Example 6 | 0.51 | 0.38 | 0.48 | 0.095 | 0.19 | 0.225 | 0.47 | 0.5 | 0 | Success |
| Example 7 | 0.51 | 0.38 | 0.26 | 0.095 | 0.19 | 0.110 | 0.42 | 0.5 | 0 | Success |
| Example 8 | 0.51 | 0.38 | 0.26 | 0.095 | 0.19 | 0.055 | 0.21 | 0.5 | 0 | Success |
| Example 9 | 0.51 | 0.38 | 0.51 | 0.095 | 0.19 | 0.055 | 0.11 | 0.5 | 0 | Success |
| Example 10 | 0.45 | 0.38 | 0.38 | 0.095 | 0.19 | 0.225 | 0.59 | 0.5 | 0 | Success |
| Example 11 | 0.51 | 0.38 | 0.38 | 0.095 | 0.19 | 0.225 | 0.59 | 0.5 | 0 | Success |
| Example 12 | 0.51 | 0.38 | 0.38 | 0.095 | 0.19 | 0.225 | 0.59 | 0.5 | 0.025 | Success |

TABLE 1-continued

| | Length L (mm) | Width W (mm) | Height T (mm) | Flange thickness D (mm) | Axial core part width w (mm) | Axial core part thickness t (mm) | Ratio t/T | Ratio w/T | Displacement B (mm) | Compaction success/ fail |
|---|---|---|---|---|---|---|---|---|---|---|
| Comparative Example 1 | 0.51 | 0.38 | 0.48 | 0.095 | 0.19 | 0.300 | 0.63 | 0.5 | 0 | Success |
| Comparative Example 2 (Target value) | 0.51 | 0.38 | 0.38 | 0.095 | 0.19 | 0.225 | 0.59 | 0.5 | 0 | Fail |

As can be appreciated from Table 1, the sample according to Comparative Example 2 with the ratio t/T set to about 0.59, which is not greater than about 0.6, is not successfully produced by the uniaxial pressing system using the powder compaction apparatus 100 according to related art. Specifically, with the sample according to Comparative Example 2, the compression ratio of the flange 40 becomes extremely low (specifically, the granules of the ceramic powder remain uncrushed), causing chipping to occur in the flange 40 at the pre-firing green stage, which makes it impossible to form a green compact. Presumably, this is due to decreased strength of the flange 40 resulting from the low compression ratio of the flange 40.

By contrast, with the sample according to Comparative Example 1 with the ratio t/T set to about 0.63, which is greater than about 0.6, a green compact is successfully produced even by the uniaxial pressing system using the powder compaction apparatus 100 according to related art. As can be appreciated from the results on Comparative Examples 1 and 2, compaction methods employing the uniaxial pressing system ceases to successfully form a green compact once the ratio t/T becomes equal to or less than about 0.6.

By contrast, with the compaction method employing a multi-axial pressing system using the powder compaction apparatus 60 illustrated in FIG. 5A, a ceramic core with desired dimensions is successfully produced even when the length dimension L is equal to or less than about 1.1 mm and the ratio t/T is equal to or less than about 0.6 (Examples 1 to 12). Specifically, when the length dimension L is about 0.85 mm and the ratio w/W is about 0.5, a ceramic core with a ratio t/T of about 0.59 (Example 1) is successfully produced. When the length dimension L is about 0.79 mm and the ratio w/W is about 0.5, ceramic cores with ratios t/T of about 0.59 (Example 2) and about 0.42 (Example 3) are successfully produced. When the length dimension L is about 0.6 mm and the ratio w/W is about 0.5, a ceramic core with a ratio t/T of about 0.59 (Example 4) is successfully produced. When the length dimension L is about 0.51 mm and the ratio w/W is about 0.5, ceramic cores with ratios of about 0.59 (Example 5, 11, 12), about 0.47 (Example 6), about 0.42 (Example 7), about 0.21 (Example 8), and about 0.11 (Example 9) are successfully produced. The ceramic core according to Example 12 is successfully produced with the amount of displacement B set to a target value of about 0.025 mm.

Next, uniformity of compaction density between the axial core part 30 and the flange 40 is evaluated by the following method. The samples used for this evaluation are the sample according to Comparative Example 1, and the sample according to Example 5, which has dimensions closest to those of Comparative Example 1 among Examples 1 to 12.

First, an ion milling apparatus IM4000 (manufactured by Hitachi High-Technologies Corporation) is used to polish the samples being evaluated, thus exposing each of the cross-section of the substantially central portion of the axial core part 30 and the cross-section of the substantially central portion of the flange 40. Subsequently, a scanning electron microscope (JSM-6390A manufactured by JEOL Ltd.) is used to capture an image of the exposed cross-sections of the axial core part 30 and the flange 40 at a magnification of about 3000 times at 18 locations (with a range of about 30×40 μm per field of view) on each of the cross-sections. Next, image analysis-type particle size distribution measurement software, Mac-View (manufactured by MOUNTEC Co., Ltd.) is used to measure the number of pores P1 and the total area of the pores P1 from the captured images. The ratio of the total number of the pores P1 in the flange 40 to the total number of the pores P1 in the axial core part 30 is determined from the measurement results. The ratio of the total area of the pores P1 in the flange 40 to the total area of the pores P1 in the axial core part 30 is also determined from the above-mentioned measurement results. The results are presented in Table 2. The total area of the pores P1 in the above-mentioned measurement results represents the proportion of the pores P1 present per predetermined area.

TABLE 2

| | Ratio between flange/axial core part | |
|---|---|---|
| | Pore count | Total pore area |
| Example 5 | 1.02 | 1.17 |
| Comparative Example 1 | 1.33 | 1.79 |

As is apparent from the results presented in Table 2, with the sample compacted by uniaxial pressing (Comparative Example 1), the compaction density of the flange 40 decreases. As a consequence, the number of pores in the flange 40 is greater than that in the axial core part 30 by as much as about 30%, and the total area of the pores P1 in the flange 40 is greater than that in the axial core part 30 by as much as about 80%.

By contrast, with the sample (Example 5) compacted by multi-stage pressing, the number of pores in the flange 40 is substantially the same as the number of pores in the axial core part 30, and the total area of the pores P1 in the flange 40 differs from that in the axial core part 30 by only about 17%. It has been confirmed from these results that producing a ceramic core by multi-stage pressing allows for reduced difference in compacting density between the axial core part 30 and the flange 40 that differ in thickness.

Next, the weight variation among the produced green compacts 20A is evaluated by the following method. The samples under evaluation in this case are samples according to Example 11 produced by the manufacturing method according to the second embodiment, and samples according to Example 5 produced by the manufacturing method according to the first embodiment and having substantially the same dimensions as those of the samples according to Example 11.

A large number of samples (the pre-firing green compacts 20A in this case) according to Example 5 and a large number of samples according to Example 11 are produced, and 10 samples are taken from among these samples. The weights of the samples are measured. The mean, the maximum value, the minimum value, and the variation (the difference between the maximum value and the minimum value) are determined from these measurements. The results are presented in Table 3.

TABLE 3

| | Weight of green compact (mg) | | | |
|---|---|---|---|---|
| | Mean | Maximum value | Minimum value | Variation |
| Example 5 | 0.196 | 0.206 | 0.188 | 0.018 |
| Example 11 | 0.197 | 0.199 | 0.195 | 0.004 |

As is apparent from the results presented in Table 3, with the samples (Example 5) with the amounts of overfill L1 and L2 both set to about 0.3 mm, the weight variation among the produced green compacts 20A is about 0.018 g.

By contrast, with the samples (Example 11) with the amount of overfill L1 set to about 0.3 mm and the amount of overfill L2 set to about 0.8 mm, the weight variation among the produced green compacts 20A is about 0.004 g, which is smaller than that with the samples according to Example 5. It has been confirmed from these results that setting the amount of overfill L2 greater than the amount of overfill L1 to increase the fill space in the flange 40 allows for reduced weight variation among the produced green compacts 20A.

It is to be understood that the present disclosure is not limited to the embodiments herein described, but various adaptations and modifications are possible with respect to features such as the kind of the raw powder used in the manufacture of the ceramic core, the specific conditions employed in the compacting step and in the subsequent firing step during manufacture, and the specific structure of the winding.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A ceramic core comprising:

an axial core part extended in a longitudinal direction; and a pair of flanges located at both ends in the longitudinal direction of the axial core part, the flanges projecting around a periphery of the axial core part in a height direction and a width direction that are orthogonal to the longitudinal direction, the ceramic core having a dimension L in the longitudinal direction of about 0 mm $<L\leq 1.1$ mm, wherein a ratio t/T is about $0<t/T\leq 0.47$, the ratio t/T being a ratio of a dimension tin the height direction of the axial core part to a dimension T in the height direction of each of the flanges, t being in a range from 0.05 mm to 0.3 mm, wherein a ratio w/W is about $0<w/W\leq 0.6$, the ratio w/W being a ratio of a dimension w in the width direction of the axial core part to a dimension W in the width direction of each of the flanges, and wherein a difference between a proportion of pores present in the axial core part and a proportion of pores present in each of the flanges is equal to or less than about 20%.

2. The ceramic core according to claim 1, wherein each of the flanges has a dimension D in the longitudinal direction that ranges from about 0.08 mm to 0.15 mm.

3. The ceramic core according to claim 1, wherein a center of the axial core part in the height direction is displaced relative to a center of each of the flanges in the height direction.

4. The ceramic core according to claim 1, wherein when viewed in cross-section taken orthogonal to the longitudinal direction, the axial core part has a body portion having a substantially elliptical or circular shape, and a projection that projects outward from each end portion in the width direction of the body portion.

5. A wire-wound electronic component comprising:

the ceramic core according to claim 1;

an electrode formed on one end face in the height direction of each of the flanges, and a winding wound around the axial core part, the winding being electrically connected at an end portion to the electrode.

6. The ceramic core according to claim 1, T being in a range from 0.1 mm to 0.6 mm.

7. A manufacturing method for a ceramic core, the ceramic core including an axial core part extended in a longitudinal direction and a pair of flanges located at both ends in the longitudinal direction of the axial core part, the ceramic core having a dimension L in the longitudinal direction of about 0 mm$<L\leq 1.1$ mm, the manufacturing method comprising:

compacting a ceramic powder filled in a die into a green compact having the axial core part and the flanges by pressing the ceramic powder with a lower punch and an upper punch, the upper punch having a segmented structure including a first upper punch and a second upper punch, the first upper punch corresponding to each of the flanges, the second upper punch corresponding to the axial core part; and firing the green compact, wherein the compacting includes individually controlling an amount of movement of each of the lower punch, the first upper punch, and the second upper punch relative to the die such that a ratio t/T is about $0<t/T\leq 0.47$, the ratio t/T being a ratio of a dimension t in a pressing direction of the axial core part after the firing to a dimension T in the pressing direction of each of the flanges after the firing, t being in a range from 0.05 mm to 0.3 mm, and wherein a difference between a proportion of pores present in the axial core part and a proportion of pores present in each of the flanges is equal to or less than about 20%.

8. The manufacturing method for a ceramic core according to claim 7, wherein the compacting includes individually controlling an amount of movement of each of the lower punch, the first upper punch, and the second upper punch relative to the die such that a ratio R1/R2 is within a range of about 0.9 to 1.1, the ratio R1/R2 being a ratio of a compression ratio R1 of each of the flanges to a compression ratio R2 of the axial core part.

9. The manufacturing method for a ceramic core according to claim 7, wherein the compacting includes filling a fill space with the ceramic powder, the fill space being defined by the lower punch and the die, advancing the upper punch into the fill space, pressing the ceramic powder within the fill space by using the upper punch and the lower punch to compact the ceramic powder into the green compact, ejecting the green compact from the die by moving the upper punch and the lower punch upward relative to the die, releasing the green compact by moving the upper punch upward, and separating, after the pressing and before the releasing, the second upper punch from the green compact earlier than the first upper punch.

10. The manufacturing method for a ceramic core according to claim 9, further comprising reducing, after the pressing and before the ejecting, pressure applied to the green compact to an extent that does not cause the upper punch and the lower punch to separate from the green compact.

11. The manufacturing method for a ceramic core according to claim 9, wherein the lower punch has a segmented structure including a first lower punch and a second lower punch, the first lower punch corresponding to each of the flanges, the second lower punch corresponding to the axial core part, wherein the filling includes filling the fill space with the ceramic powder by positioning the first lower punch lower than a pressing start position by a first amount of overfill, and by positioning the second lower punch lower than a pressing start position by a second amount of overfill, and transferring each of the first lower punch and the second lower punch to the pressing start position by moving the first lower punch and the second lower punch upward relative to the die, and wherein the second amount of overfill is set greater than the first amount of overfill.

12. The manufacturing method for a ceramic core according to claim 11, wherein the second amount of overfill is set greater than the first amount of overfill such that an upper face of the second lower punch is positioned flush with an upper face of the first lower punch or lower than the upper face of the first lower punch.

13. The manufacturing method for a ceramic core according to claim 7, T being in a range from 0.1 to 0.6 mm.

14. The ceramic core according to claim 1, w being in a range from 0.05 mm to 0.3 mm.

15. The manufacturing method for a ceramic core according to claim 8, wherein a ratio w/W is about $0<w/W\leq 0.6$, the ratio w/W being a ratio of a dimension w in the width direction of the axial core part to a dimension W in the width direction of each of the flanges, w being in a range from 0.05 mm to 0.3 mm.

* * * * *